US011814806B2

(12) United States Patent
Niroumand

(10) Patent No.: US 11,814,806 B2
(45) Date of Patent: Nov. 14, 2023

(54) MULTI-FUNCTION RETAINING STRUCTURE AND IMPLEMENTATION METHOD THEREOF

(71) Applicant: Bahman Niroumand, Boushehr (IR)

(72) Inventor: Bahman Niroumand, Boushehr (IR)

( * ) Notice: Subject to any disclaimer, the term of this patent is extended or adjusted under 35 U.S.C. 154(b) by 422 days.

(21) Appl. No.: 17/096,501

(22) Filed: Nov. 12, 2020

(65) Prior Publication Data

US 2021/0062450 A1 Mar. 4, 2021

Related U.S. Application Data

(60) Provisional application No. 62/933,998, filed on Nov. 12, 2019.

(51) Int. Cl.

| | |
|---|---|
| ***E02D 3/00*** | (2006.01) |
| ***E02D 19/10*** | (2006.01) |
| ***E02D 7/24*** | (2006.01) |
| ***E02D 5/28*** | (2006.01) |
| ***E02D 29/00*** | (2006.01) |
| ***E02D 31/02*** | (2006.01) |
| ***E02D 7/06*** | (2006.01) |

(52) U.S. Cl.

CPC ..... *E02D 19/10* (2013.01); *E02D 3/00* (2013.01); *E02D 5/285* (2013.01); *E02D 7/06* (2013.01); *E02D 7/24* (2013.01); *E02D 29/00* (2013.01); *E02D 31/02* (2013.01); *E02D 2300/0085* (2013.01); *E02D 2600/30* (2013.01)

(58) Field of Classification Search

CPC .. E02D 3/00; E02D 19/10; E02D 7/24; E02D 5/28; E02D 7/06; E02D 29/00; E02D 5/285

See application file for complete search history.

(56) References Cited

U.S. PATENT DOCUMENTS

| | | | | | |
|---|---|---|---|---|---|
| 635,165 | A | * | 10/1899 | Weyhe | E02D 29/025 52/125.2 |
| 1,924,346 | A | * | 8/1933 | Blumenthal | E02D 5/28 405/232 |
| 1,998,017 | A | * | 4/1935 | Jaekle | E02D 5/28 405/231 |

FOREIGN PATENT DOCUMENTS

| | | | |
|---|---|---|---|
| CA | 1039071 | * | 9/1978 |
| GB | 924859 | * | 5/1963 |

* cited by examiner

*Primary Examiner* — Sean D Andrish

(74) *Attorney, Agent, or Firm* — Bajwa IP Law Firm; Haris Zaheer Bajwa

(57) ABSTRACT

A multi-function retaining structure for excavation and drainage operations during construction process and a method for excavation and implementation of a multi-function retaining structure at a target location. The multi-function retaining structure includes a first I-beam, a second I-beam, a third I-beam, a first inclined stiffener plate, and a second inclined stiffener plate. The method includes positioning the multi-function retaining structure above the target location, driving the multi-function retaining structure into the target location by pushing the bottom edge of the third web into the target location, softening soils in the target location by jetting water to the soils utilizing a first water jet tube and a second water jet tube, extracting the first water jet tube and the second water jet tube from the rectangular chamber, and draining water from the rectangular chamber by utilizing a water drainage pump and through a drainage tube.

19 Claims, 24 Drawing Sheets

100

100

100

507

509

600

MULTI-FUNCTION RETAINING STRUCTURE AND IMPLEMENTATION METHOD THEREOF

CROSS-REFERENCE TO RELATED APPLICATION

This application claims the benefit of priority from U.S. Provisional Patent Application Ser. No. 62/933,998, filed on Nov. 12, 2019, and entitled "THE PROCESS OF EXCAVATION AND IMPLEMENTATION OF MULTI-FUNCTION RETAINING STRUCTURE" which is incorporated herein by reference in its entirety.

TECHNICAL FIELD

The present disclosure generally relates to retaining structures. The present disclosure more particularly relates to a method and a system for excavation and implementation of a multi-function retaining structure.

BACKGROUND

In spite of the growth and development of many methods of soil wall stabilization, the excavation and implementation of retaining structures in conditions such as, loose granular soil formations and high groundwater levels within the excavation site may be rendered ineffective and expensive. This may pose a serious challenge to civil engineers. Especially, in an urban setting, the employment of machinery is impractical as excavation sites in urban areas are often surrounded by infrastructure. Owing to this, some known non-standard methods such as diaphragm wall method and tie back nailing method are implemented, which have time and again proved to be equally ineffective and expensive. There is, therefore, a need for effective and non-expensive methods and systems for excavation and implementation of retaining structures.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments of the present disclosure, a multi-function retaining structure for excavation and drainage operations during construction process is disclosed. In an exemplary embodiment, the disclosed multi-function retaining structure may include a first I-beam, a second I-beam, a third I-beam, a first inclined stiffener plate, and a second inclined stiffener plate. In an exemplary embodiment, the first I-beam may include a first web. In an exemplary embodiment, the second I-beam may include a second web. In an exemplary embodiment, a first side of the first I-beam may be fixedly connected to a first side of the second I-beam. In an exemplary embodiment, a main surface of the second web may be parallel to a main surface of the first web. In an exemplary embodiment, the first I-beam and the second I-beam may define a rectangular chamber between the first web and the second web.

In an exemplary embodiment, the third I-beam may include a third web. In an exemplary embodiment, the third I-beam may be interconnected between a bottom end of the first I-beam and a bottom end of the second I-beam. In an exemplary embodiment, a top edge of the first inclined stiffener plate may be attached to a bottom edge of the first web. In an exemplary embodiment, a bottom edge of the first inclined stiffener plate may be attached to a bottom edge of the third web. In an exemplary embodiment, a top edge of the second inclined stiffener plate may be attached to a bottom edge of the second web. In an exemplary embodiment, a bottom edge of the second inclined stiffener plate may be attached to the bottom edge of the third web.

In an exemplary embodiment, the first inclined stiffener plate and the second inclined stiffener plate may be configured to reduce soil penetration into the rectangular chamber due to the first inclined stiffener plate and the second inclined stiffener plate closing a bottom end of the rectangular chamber. In an exemplary embodiment, the first inclined stiffener plate, the second inclined stiffener plate, and a bottom edge of the third web form a wedge-shaped tip, the wedge-shaped tip may be configured to penetrate into soil and tamper through hard rock surfaces.

In an exemplary embodiment, the disclosed multi-function retaining structure may include a water drainage mechanism. In an exemplary embodiment, the water drainage mechanism may include a water carrying tube, a plurality of slots, a drainage tube, and a filter mechanism. In an exemplary embodiment, the water carrying tube may be disposed inside the rectangular chamber.

In an exemplary embodiment, the plurality of slots may be provided on the water carrying tube. In an exemplary embodiment, the plurality of slots may be configured to allow water to penetrate into the water carrying tube from the rectangular chamber and through the plurality of slots. In an exemplary embodiment, the drainage tube may be disposed inside the water carrying tube. In an exemplary embodiment, the filter mechanism may be attached to a bottom end of the drainage tube. In an exemplary embodiment, the filter mechanism may be configured to allow water penetration into the drainage tube through the bottom end of the drainage tube. In an exemplary embodiment, the filter mechanism may be configured to prevent soil penetration into the drainage tube through the bottom end of the drainage tube.

In an exemplary embodiment, a top end of the drainage tube may be connected to a water drainage pump. In an exemplary embodiment, the water drainage pump may be configured to drain water from the rectangular chamber and through the drainage tube.

In an exemplary embodiment, the first I-beam may further include a first lateral flange and a second lateral flange. In an exemplary embodiment, the first lateral flange may be attached to a first lateral edge of the first web. In an exemplary embodiment, a main plane of the first lateral flange may be perpendicular to the main plane of the first web.

In an exemplary embodiment, the second lateral flange may be attached to a second lateral edge of the first web. In an exemplary embodiment, a main plane of the second lateral flange may be perpendicular to the main plane of the first web. In an exemplary embodiment, the main plane of the second lateral flange may be parallel to the main plane of the first lateral flange.

In an exemplary embodiment, the second I-beam may further include a third lateral flange and a fourth lateral flange. In an exemplary embodiment, the third lateral flange may be attached to a first lateral edge of the second web. In an exemplary embodiment, a main surface of the third lateral flange may be perpendicular to the main surface of the second web. In an exemplary embodiment, fourth lateral flange may be attached to a second lateral edge of the second web.

In an exemplary embodiment, a main surface of the fourth lateral flange may be perpendicular to the main surface of the second web. In an exemplary embodiment, the main surface of the third lateral flange may be parallel to the main surface of the fourth lateral flange. In an exemplary embodiment, the first lateral flange may be fixedly attached to the third lateral flange. In an exemplary embodiment, the second lateral flange may be fixedly attached to the fourth lateral flange.

In an exemplary embodiment, the disclosed multi-function retaining structure may include a geotextile layer. In an exemplary embodiment, the geotextile layer may be coated onto an outer surface of the water carrying tube. In an exemplary embodiment, the geotextile layer may be configured to prevent soil penetration into the water carrying tube from the rectangular chamber and through the outer surface of the water carrying tube. In an exemplary embodiment, the geotextile layer may further be configured to allow water penetration into the water carrying tube from the rectangular chamber and through the outer surface of the water carrying tube.

In an exemplary embodiment, the disclosed multi-function retaining structure may further include a first water jet tube and a second water jet tube. In an exemplary embodiment, the first water jet tube may be disposed inside the rectangular chamber. In an exemplary embodiment, the first water jet tube may include a first jetting element at a bottom end of the first water jet tube. In an exemplary embodiment, the first jetting element may be disposed inside a first jet tube hole of the first inclined stiffener plate.

In an exemplary embodiment, the first jetting element may include a first bottom inclined surface and a first pair of holes. In an exemplary embodiment, the first bottom inclined surface may be provided at a bottom end of the first jetting element. In an exemplary embodiment, the first pair of holes may be provided on the first bottom inclined surface. In an exemplary embodiment, the first pair of holes increasing intensity of water discharge from the first water jet tube.

In an exemplary embodiment, the second water jet tube may be disposed inside the rectangular chamber. In an exemplary embodiment, the second water jet tube may include a second jetting element at a bottom end of the second water jet tube. In an exemplary embodiment, the second jetting element may be disposed inside a second jet tube hole of the second inclined stiffener plate.

In an exemplary embodiment, the second jetting element may include a second bottom inclined surface and a second pair of holes. In an exemplary embodiment, the second bottom inclined surface may be at a bottom end of the second jetting element. In an exemplary embodiment, the second pair of holes may be on the second bottom inclined surface. In an exemplary embodiment, the second pair of holes may be able to increase intensity of water discharge from the second water jet tube.

In an exemplary embodiment, the disclosed multi-function retaining structure may further include a water jet pump. In an exemplary embodiment, the water jet pump may be connected to a top end of the first water jet tube. In an exemplary embodiment, the water jet pump may be connected to a top end of the second water jet tube. In an exemplary embodiment, the water jet pump may be configured to pump water into the first water jet tube and the second water jet tube.

In an exemplary embodiment, the disclosed multi-function retaining structure may further include a first plurality of connecting plates and a second plurality of connecting plates. In an exemplary embodiment, the first plurality of connecting plates may be configured to connect the first side of the first I-beam to the first side of the second I-beam. In an exemplary embodiment, each connecting plate form the first plurality of connecting plates may be interconnected between the first lateral flange and the third lateral flange. In an exemplary embodiment, the second plurality of connecting plates may be configured to connect the first side of the first I-beam to the first side of the second I-beam. In an exemplary embodiment, each connecting plate from the second plurality of connecting plates may be interconnected between the second lateral flange and the fourth lateral flange.

In an exemplary embodiment, a first side of each of the first plurality of connecting plates may be attached fixedly to an inner side of the first lateral flange. In an exemplary embodiment, a second side of each of the first plurality of connecting plates may be attached fixedly to an inner side of the third lateral flange. In an exemplary embodiment, a first side of each of the second plurality of connecting plates may be attached fixedly to an inner side of the second lateral flange. In an exemplary embodiment, a second side of each of the second plurality of connecting plates may be attached fixedly to an inner side of the fourth lateral flange.

According to one or more exemplary embodiments of the present disclosure, a method for excavation and implementation of a multi-function retaining structure at a target location is disclosed. In an exemplary embodiment, the disclosed method may include positioning the multi-function retaining structure above the target location, driving the multi-function retaining structure into the target location by pushing the bottom edge of the third web into the target location, softening soils in the target location by jetting water to the soils utilizing a first water jet tube and a second water jet tube, extracting the first water jet tube and the second water jet tube from the rectangular chamber, and draining water from the rectangular chamber by utilizing a water drainage pump and through a drainage tube.

In an exemplary embodiment, the method may further include reducing soil penetration into the rectangular chamber by closing a bottom end of the rectangular chamber by utilizing the first inclined stiffener plate and the second inclined stiffener plate. In an exemplary embodiment, the method may further include disposing a water carrying tube inside the rectangular chamber and disposing the drainage tube inside the water carrying tube.

In an exemplary embodiment, the method may further include allowing water penetration into the drainage tube through the bottom end of the drainage tube and preventing soil penetration into the drainage tube through the bottom end of the drainage tube by attaching a filter mechanism to a bottom end of the drainage tube. In an exemplary embodiment, the method may further include allowing water to penetrate into the water carrying tube from the rectangular chamber by providing a plurality of slots on the water carrying tube.

In an exemplary embodiment, the method may further include preventing soil penetration into the water carrying tube from the rectangular chamber and through the outer surface of the water carrying tube and allowing water penetration into the water carrying tube from the rectangular chamber and through the outer surface of the water carrying tube by coating a geotextile layer onto an outer surface of the water carrying tube. In an exemplary embodiment, the method may further include penetrating into soil and tamper through hard rock surfaces by forming a wedge-shaped tip between the first inclined stiffener plate, the second inclined stiffener plate, and bottom edge of the third. In an exemplary embodiment, the method may further include pumping water into the first water jet tube and the second water jet tube by connecting a water jet pump to a top end of the first water jet tube and a top end of the second water jet tube.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed a multi-function retaining structure for excavation and a method for implementation of an exemplary multi-function retaining structure. An exemplary multi-function retaining structure includes two I-beams which may be attached laterally to each other in such a way that a rectangular chamber between the two I-beams is formed. An exemplary multi-function retaining structure may be inserted into the ground at a target location in order to stabilize a soil wall. An exemplary multi-function retaining structure may also be used to drain water from lower layers of the ground at the target location. When the multi-function retaining structure may be inserted into the ground at a target location, water carrying tube may be disposed inside the rectangular chamber and a drainage tube may be disposed inside the water carrying tube. A water drainage pump may be connected to a top end of the drainage tube. The water drainage tube may drain water from the water carrying tube and through the drainage tube.

Figure 1A:
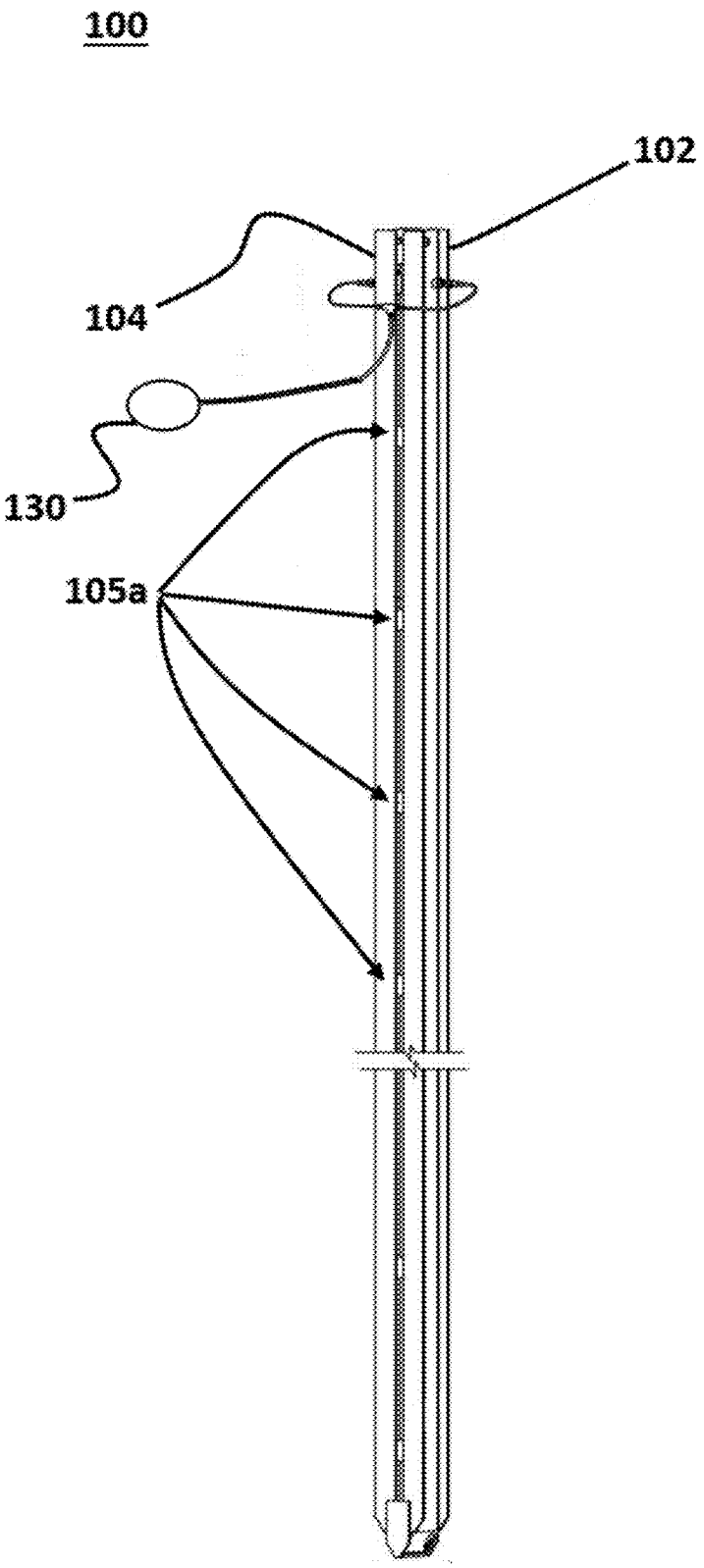
FIG. 1A illustrates a perspective view of a multi-function retaining structure, consistent with one or more exemplary embodiments of the present disclosure.
Figure 1B:
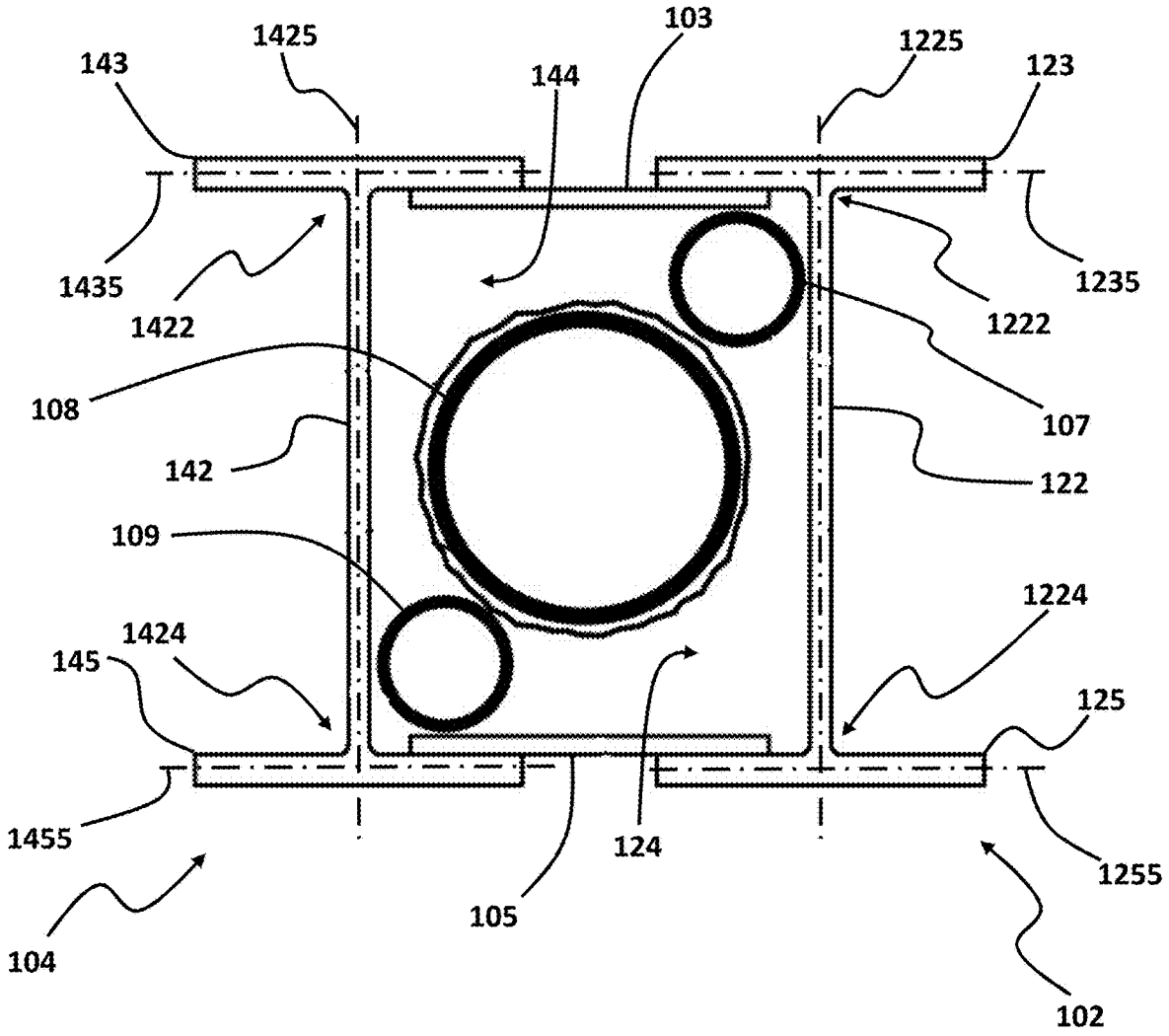
FIG. 1B illustrates a top view of a multi-function retaining structure, consistent with one or more exemplary embodiments of the present disclosure.

FIG. 1A shows a perspective view of a multi-function retaining structure 100, consistent with one or more exemplary embodiments of the present disclosure. FIG. 1B shows a top view of multi-function retaining structure 100, consistent with one or more exemplary embodiments of the present disclosure. As shown in FIG. 1A and FIG. 1B, in an exemplary embodiment, multi-function retaining structure 100 may include a first I-beam 102 and a second I-beam 104. In an exemplary embodiment, first I-beam 102 may include a first web 122, a first lateral flange 123, and a second lateral flange 125. In an exemplary embodiment, it may be understood that a web may refer to a plate that may be interconnected between two lateral flanges of an I-beam. In an exemplary embodiment, a web may be interconnected between two lateral flanges of an I-beam in such a way that a main plane of the web is perpendicular to main planes of the two lateral flanges. For example, first I-beam 102 may refer to a plate that may be interconnected between first lateral flange 123 and second lateral flange 125. In an exemplary embodiment, first lateral flange 123 may be attached to a first lateral edge 1222 of first web 122. In an exemplary embodiment, second lateral flange 125 may be attached to a second lateral edge 1224 of first web 122. In an exemplary embodiment, first lateral flange 123 may be attached to first lateral edge 1222 of first web 122 in such a way that a main plane 1235 of first lateral flange 123 may be perpendicular to a main plane 1225 of first web 122. In an exemplary embodiment, first lateral flange 123 may be attached to first lateral edge 1222 of first web 122 through a welding process or any other connecting approaches. In an exemplary embodiment, first lateral flange 123 and first web 122 may be manufactured seamlessly in order to constitute a unique or unitary/integral part.

In an exemplary embodiment, second lateral flange 125 may be attached to second lateral edge 1224 of first web 122 in such a way that a main plane 1255 of second lateral flange 125 may be perpendicular to main plane 1225 of first web 122. In an exemplary embodiment, second lateral flange 125 may be attached to second lateral edge 1224 of first web 122 in such a way that main plane 1255 of second lateral flange 125 may also be parallel to main plane 1235 of first lateral flange 123. In an exemplary embodiment, second lateral flange 125 may be attached to second lateral edge 1224 of first web 122 through a welding process or any other connecting approaches. In an exemplary embodiment, second lateral flange 125 and first web 122 may be manufactured seamlessly in order to constitute a unique or unitary/integral part.

In an exemplary embodiment, second I-beam 104 may include a second web 142, a third lateral flange 143, and a fourth lateral flange 145. In an exemplary embodiment, third lateral flange 143 may be attached to a first lateral edge 1422 of second web 142. In an exemplary embodiment, third lateral flange 143 may be attached to first lateral edge 1422 of second web 142 through a welding process or any other connecting approaches. In an exemplary embodiment, third lateral flange 143 and second web 142 may be manufactured seamlessly in order to constitute a unique or unitary/integral part. In an exemplary embodiment, fourth lateral flange 145 may be attached to a second lateral edge 1424 of second web 142. In an exemplary embodiment, fourth lateral flange 145 may be attached to second lateral edge 1424 of second web 142 through a welding process or any other connecting approaches. In an exemplary embodiment, third lateral flange 143 and second web 142 may be manufactured seamlessly in order to constitute a unique or unitary/integral part.

In an exemplary embodiment, third lateral flange 143 may be attached to first lateral edge 1422 of second web 142 in such a way that a main plane 1435 of third lateral flange 143 may be perpendicular to a main plane 1425 of second web 142. In an exemplary embodiment, fourth lateral flange 145 may be attached to second lateral edge 1424 of second web 142 in such a way that a main plane 1455 of fourth lateral flange 145 may be perpendicular to main plane 1425 of second web 142. In an exemplary embodiment, fourth lateral flange 145 may be attached to second lateral edge 1424 of second web 142 in such a way that main plane 1455 of fourth lateral flange 145 may also be parallel to main plane 1435 of third lateral flange 143.

In an exemplary embodiment, a first side 124 of first I-beam 102 may be fixedly connected to a first side 144 of second I-beam 104. In an exemplary embodiment, when first side 124 of first I-beam 102 is fixedly connected to first side 144 of second I-beam 104, first side 124 of first I-beam 102 may be connected to first side 144 of second I-beam 104 in such a way that any movement between first I-beam 102 and second I-beam 104 may be prevented. In an exemplary embodiment, first I-beam 102 may be connected to first side 144 of second I-beam 104 by utilizing a plurality of connecting plates.

Figure 1C:
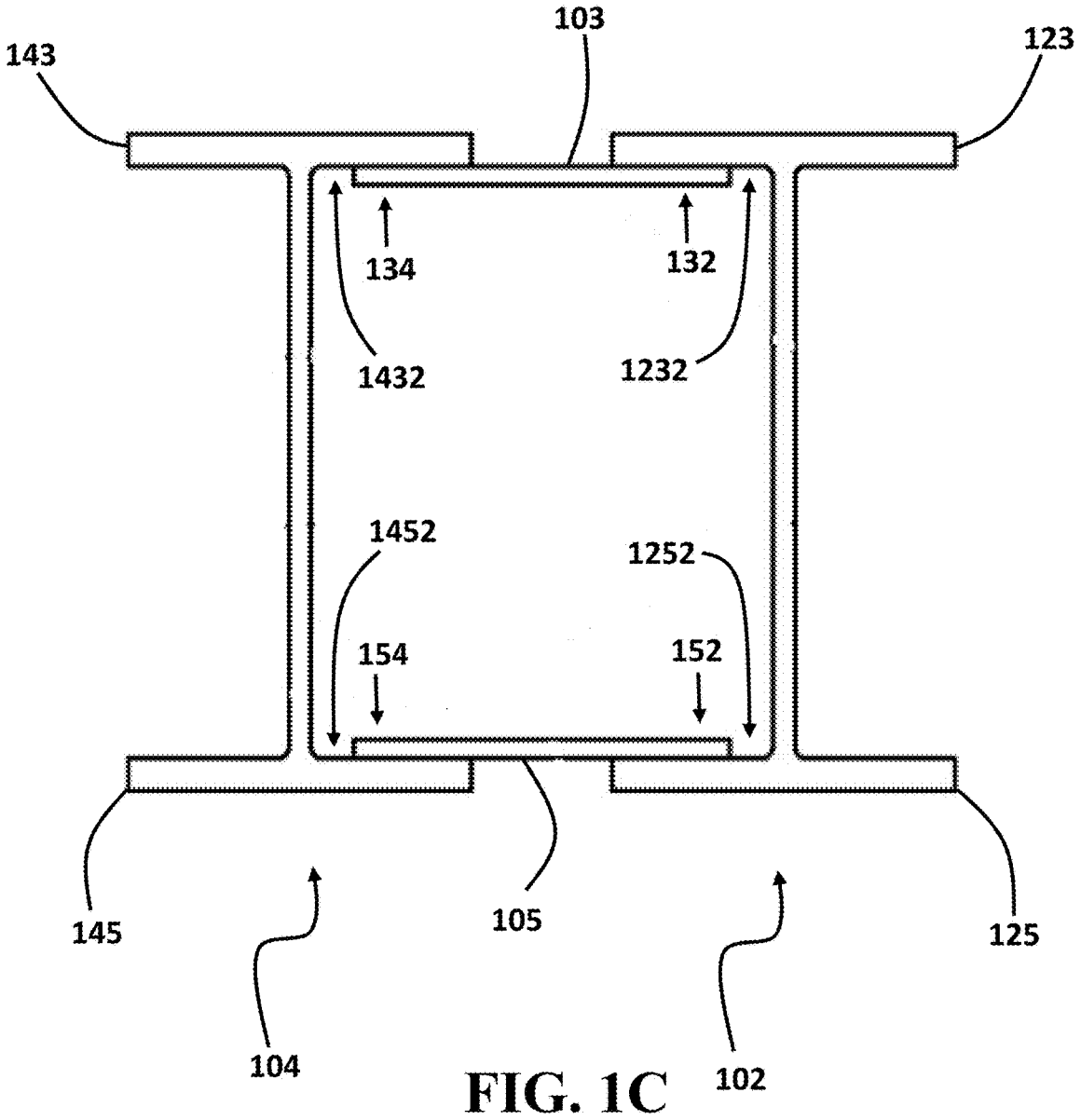
FIG. 1C illustrates a top view of a multi-function retaining structure, consistent with one or more exemplary embodiments of the present disclosure.

FIG. 1C shows a top view of multi-function retaining structure 100, consistent with one or more exemplary embodiments of the present disclosure. As shown in FIG. 1C, in an exemplary embodiment, multi-function retaining structure 100 may further include a first connecting plate 103 having a rectangular shape and a second connecting plate 105 having a rectangular shape. In an exemplary embodiment, first connecting plate 103 and second connecting plate 105 may be utilized to connect first side 124 of first I-beam 102 to first side 144 of second I-beam 104. In an exemplary embodiment, first lateral flange 123 may be connected to third lateral flange 143 by utilizing first connecting plate 103. In an exemplary embodiment, a first end 132 of first connecting plate 103 may be attached to an inner side 1232 of first lateral flange 123. In an exemplary embodiment, a second end 134 of first connecting plate 103 may be attached to an inner side 1432 of third lateral flange 143. In an exemplary embodiment, multi-function retaining structure 100 may include a first plurality of connecting plates (obscured from the view in FIG. 1A). In an exemplary embodiments, each of the first plurality of connecting plates may be similar to first connecting plate 103 in size and shape. In an exemplary embodiment, each of the first plurality of connecting plates may be attached to inner side 1232 of first lateral flange 123 and inner side 1432 of third lateral flange 143. In an exemplary embodiment, it may be understood that when the first plurality of connecting plates are attached to inner side 1232 of first lateral flange 123 and inner side 1432 of third lateral flange 143, first lateral flange 123 may be fixedly connected to third lateral flange 143.

In an exemplary embodiment, second lateral flange 125 may be connected to fourth lateral flange 145 by utilizing second connecting plate 105. In an exemplary embodiment, a first end 152 of second connecting plate 105 may be attached to an inner side 1252 of third lateral flange 125. In an exemplary embodiment, a second end 154 of second connecting plate 105 may be attached to an inner side 1452 of fourth lateral flange 145. In an exemplary embodiment, multi-function retaining structure 100 may include a second plurality of connecting plates 105*a*. In an exemplary embodiments, each of second plurality of connecting plates 105*a* may be similar to second connecting plate 105 in size and shape. In an exemplary embodiment, each of second plurality of connecting plates 105*a* may be attached to inner side 1252 of second lateral flange 125 and inner side 1452 of fourth lateral flange 145. In an exemplary embodiment, it may be understood that when second plurality of connecting plates 105*a* are attached to inner side 1252 of second lateral flange 125 and inner side 1452 of fourth lateral flange 145, second lateral flange 125 may be fixedly connected to fourth lateral flange 145.

Figure 1D:
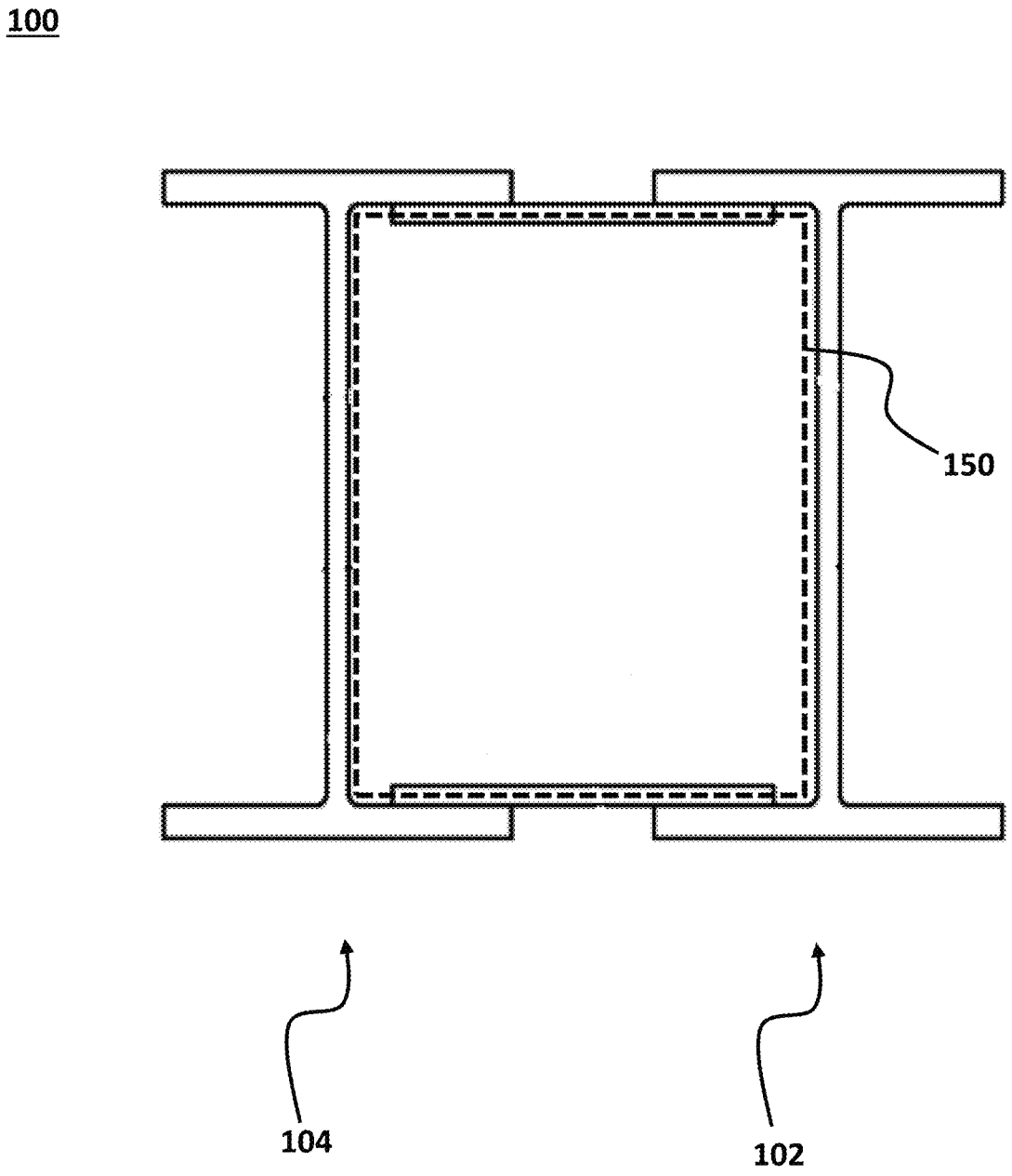
FIG. 1D illustrates a top view of a multi-function retaining structure, consistent with one or more exemplary embodiments of the present disclosure.
Figure 1E:
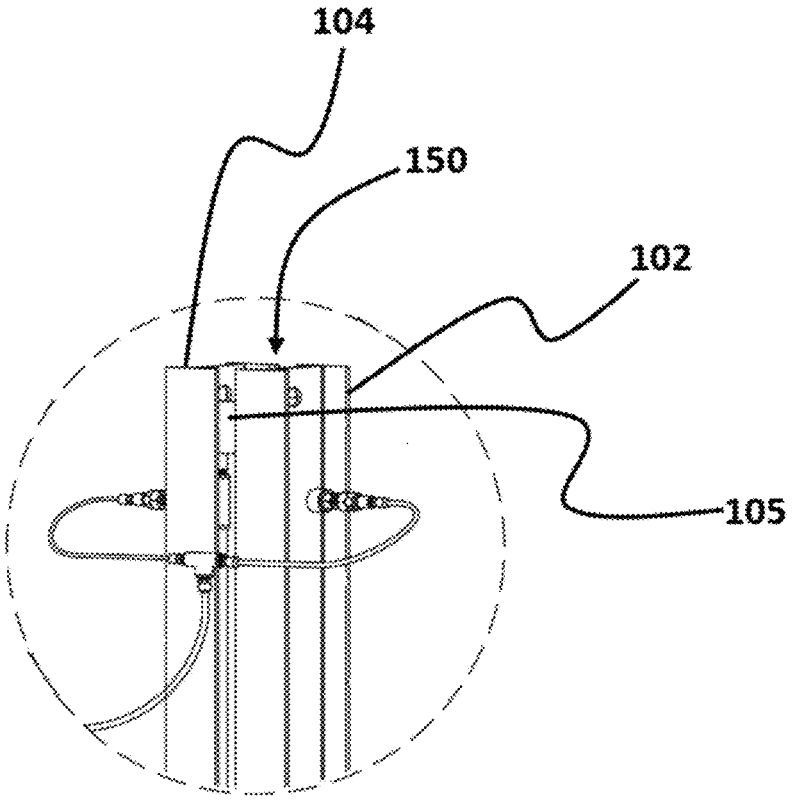
FIG. 1E illustrates a top section of a multi-function retaining structure, consistent with one or more exemplary embodiments of the present disclosure.
Figure 1F:
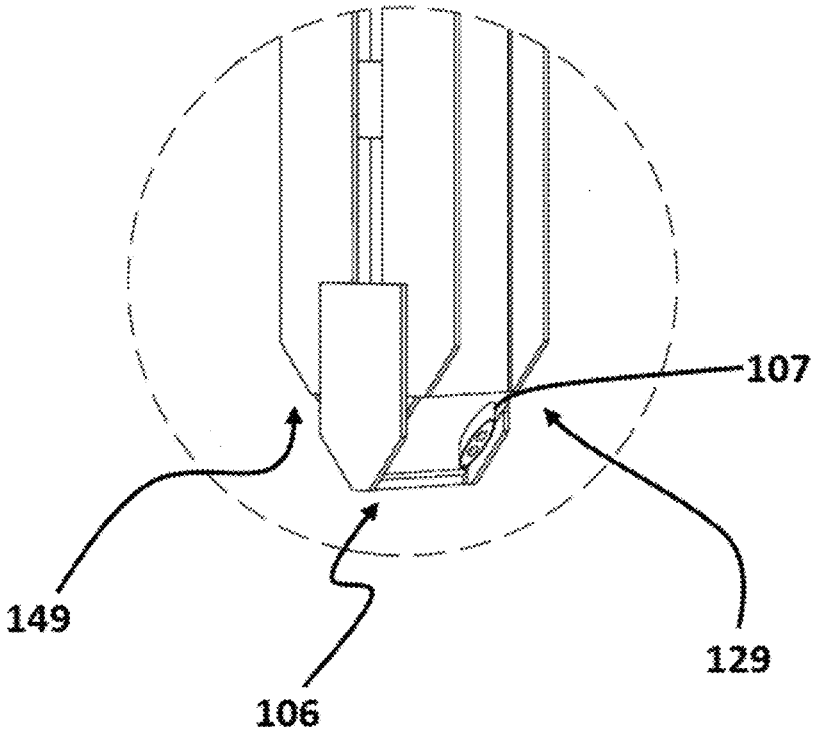
FIG. 1F illustrates a bottom section of a multi-function retaining structure, consistent with one or more exemplary embodiments of the present disclosure.

In an exemplary embodiment, it may be understood that when first lateral flange 123 is fixedly connected to third lateral flange 143 and second lateral flange 125 is fixedly connected to fourth lateral flange 145, first side 124 of first I-beam 102 may be fixedly connected to first side 144 of second I-beam 104. In an exemplary embodiment, first side 124 of first I-beam 102 and first side 144 of second I-beam 104 may be fixedly connected to each other in such a way that main plane 1425 of second web 142 is parallel to main plane 1225 of first web 122. In an exemplary embodiment, when first side 124 of first I-beam 102 is connected to first side 144 of second I-beam 104, a rectangular chamber 150 may be formed between first web 122 and second web 142. FIG. 1D shows a top view of multi-function retaining structure 100, consistent with one or more exemplary embodiments of the present disclosure. In an exemplary embodiment, rectangular chamber 150 may be formed between first web 122, second web 142, first plurality of connecting plates, and second plurality of connecting plates 105*a*. FIG. 1E shows a top section of a multi-function retaining structure, consistent with one or more exemplary embodiments of the present disclosure. FIG. 1F shows a bottom section of a multi-function retaining structure, consistent with one or more exemplary embodiments of the present disclosure.

Figure 2:
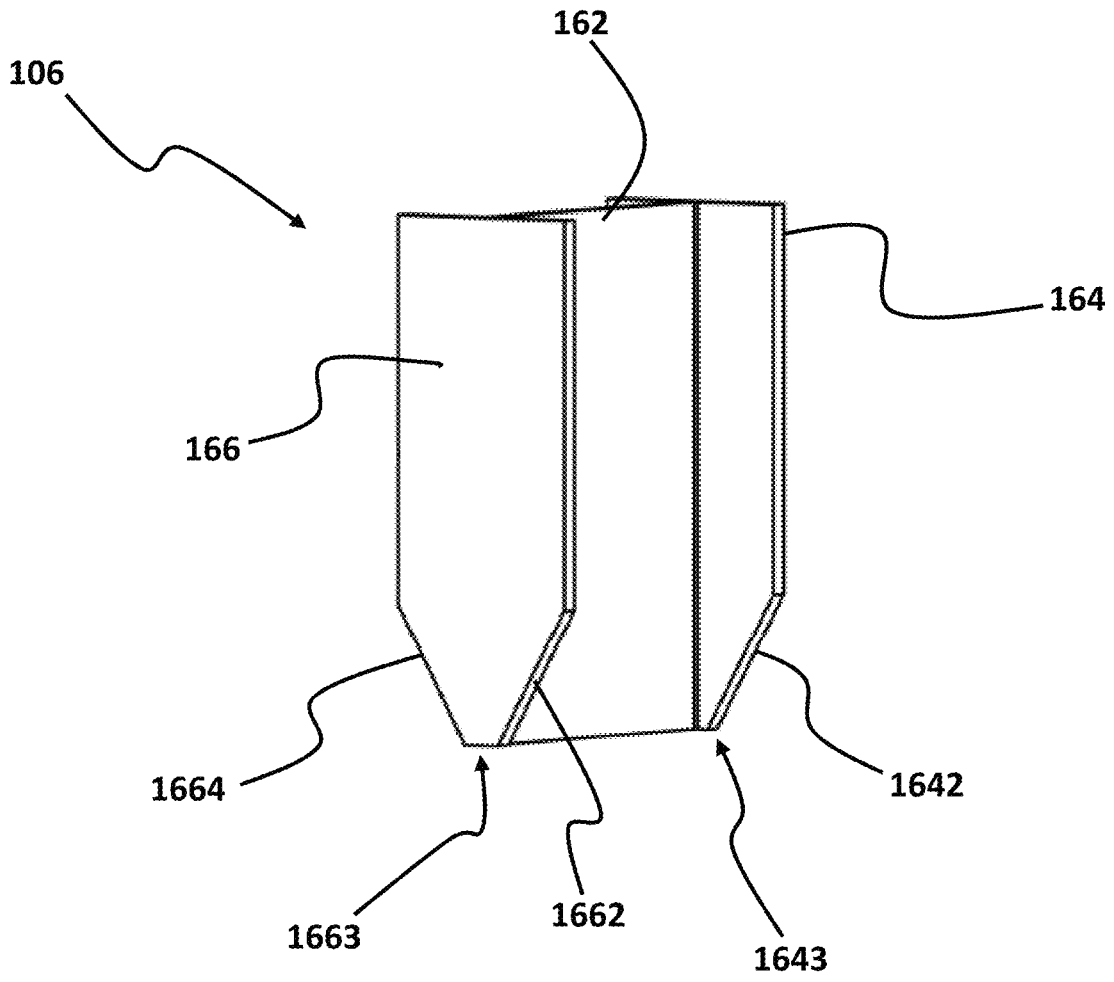
FIG. 2 illustrates a perspective view of a third I-beam, consistent with one or more exemplary embodiments of the present disclosure.

In an exemplary embodiment, multi-function retaining structure 100 may further include a third I-beam 106. FIG. 2 shows a perspective view of third I-beam 106, consistent with one or more exemplary embodiments of the present disclosure. As shown in FIG. 2, in an exemplary embodiment, third I-beam 106 may include a third web 162, a fifth lateral flange 164, and a sixth lateral flange 166. In an exemplary embodiment, a first end of third web 162 may be connected to fifth lateral flange 164 and a second end of third web 162 may be connected to sixth lateral flange 166. In an exemplary embodiment, fifth lateral flange 164 may include a first inclined edge 1642 and a second inclined edge (obscured form view in FIG. 2) at a bottom end 1643 of fifth lateral flange 164. In an exemplary embodiment, first inclined edge 1642 and the second inclined edge may offer a facility for fifth lateral flange 164 that enables fifth lateral flange 164 to penetrate into soil more easily. In an exemplary embodiment, sixth lateral flange 166 may include a third inclined edge 1662 and a fourth inclined edge 1664 at a bottom end 1663 of sixth lateral flange 166. In an exemplary embodiment, third inclined edge 1662 and fourth inclined edge 1664 may offer a facility for fifth lateral flange 164 that enables fifth lateral flange 164 to penetrate into soil more easily. In an exemplary embodiment, it may be understood that first inclined edge 1642, the second inclined edge, third inclined edge 1662, and fourth inclined edge 1664 may help third I-beam 106 to penetrate into soil more easily.

In an exemplary embodiment, third I-beam 106 may be disposed between first I-beam 102 and second I-beam 104. In an exemplary embodiment, third I-beam 106 may be disposed inside rectangular chamber 150. In an exemplary embodiment, third I-beam 106 may be attached to a bottom end 129 of first I-beam 102 and a bottom end 149 of second I-beam 104. In an exemplary embodiment, an inner surface of sixth lateral flange 166 may be attached to an outer surface of second lateral flange 125 and an outer surface of fourth lateral flange 145. In an exemplary embodiment, an inner surface of 164 may be attached to an outer surface of first lateral flange 123 and an outer surface of third lateral flange 143. In an exemplary embodiment, it may be understood third I-beam 106 may provide significant benefits. For example, third I-beam 106 may help multi-function retaining structure 100 to be inserted into the ground at a target location more easily and more rapidly.

Figure 3A:
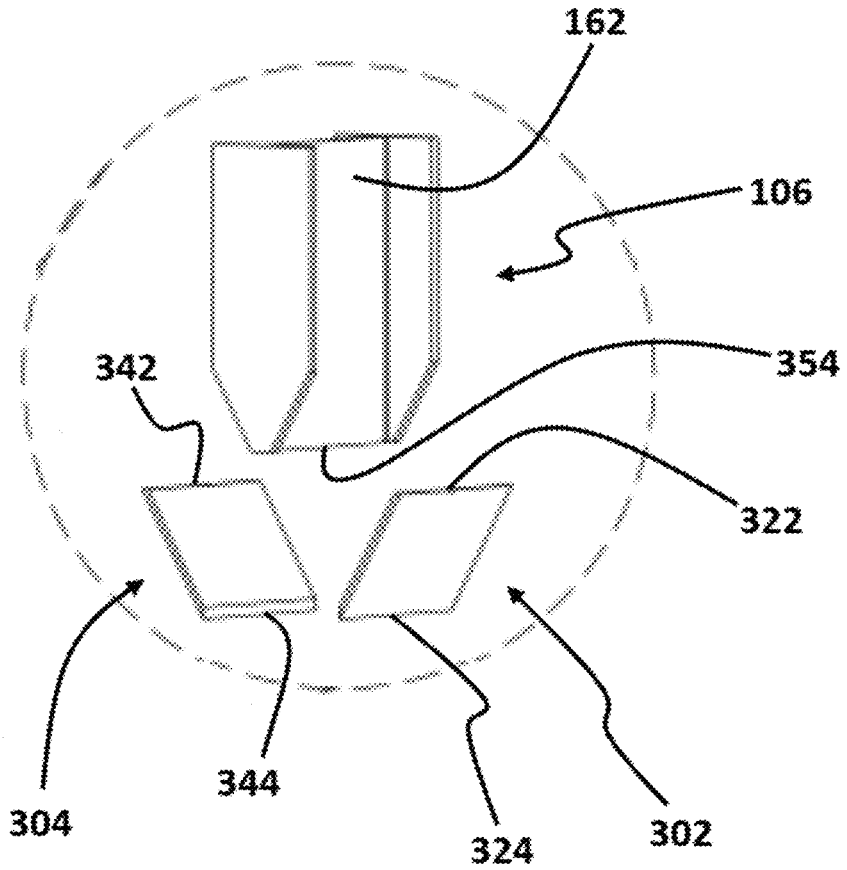
FIG. 3A illustrates a perspective view of a bottom section of a multi-function retaining structure, consistent with one or more exemplary embodiments of the present disclosure.
Figure 3B:
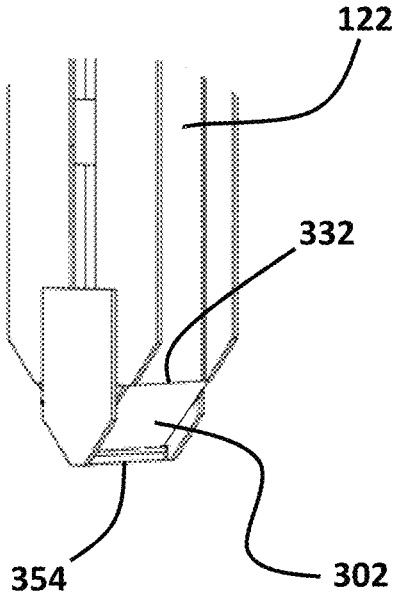
FIG. 3B illustrates a perspective view of a bottom section of multi-function retaining structure, consistent with one or more exemplary embodiments of the present disclosure.
Figure 3C:
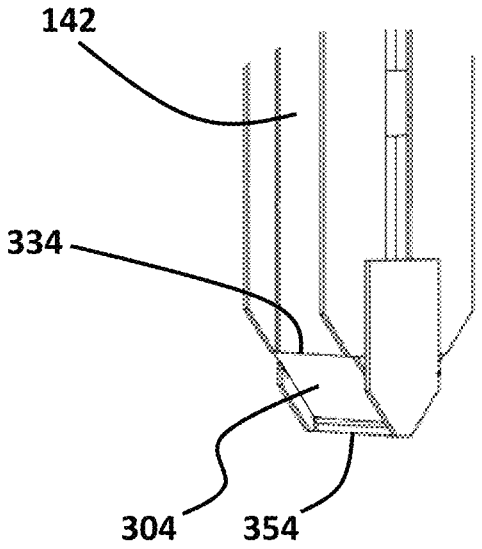
FIG. 3C illustrates a perspective view of a bottom section of multi-function retaining structure, consistent with one or more exemplary embodiments of the present disclosure.

FIG. 3A shows a perspective view of a multi-function retaining structure 100, consistent with one or more exemplary embodiments of the present disclosure. FIG. 3B shows a perspective view of a bottom section of multi-function retaining structure 100, consistent with one or more exemplary embodiments of the present disclosure. FIG. 3C shows a perspective view of a bottom section of multi-function retaining structure 100, consistent with one or more exemplary embodiments of the present disclosure. As shown in FIG. 3A, FIG. 3B, and FIG. 3C, in an exemplary embodiment, multi-function retaining structure 100 may further include a first inclined stiffener plate 302 and a second inclined stiffener plate 304. In an exemplary embodiment, a top edge 322 of first inclined stiffener plate 302 may be attached to a bottom edge 332 of first web 122. In an exemplary embodiment, a bottom edge 324 of first inclined stiffener plate 302 may be attached to a bottom edge 354 of third web 162. In an exemplary embodiment, bottom edge 324 of first inclined stiffener plate 302 may be attached to a first side of third web 162 and above bottom edge 354 of third web 162. In an exemplary embodiment, a first inclination angle may be defined between a main plane of first inclined stiffener plate 302 and a main plane of third web 162. In an exemplary embodiment, a value of the first inclination angle may be in a range between 30 degrees to 60 degrees. In an exemplary embodiment, the value of the first inclination angle may be 45 degrees. In an exemplary embodiment, a top edge 342 of second inclined stiffener plate 304 may be attached to a bottom edge 334 of second web 142. In an exemplary embodiment, a bottom edge 344 of second inclined stiffener plate 304 may be attached to a bottom edge 354 of third web 162. In an exemplary embodiment, bottom edge 344 of second inclined stiffener plate 304 may be attached to a second side of third web 162 and above bottom edge 354 of third web 162. In an exemplary embodiment, a second inclination angle may be defined between a main plane of second inclined stiffener plate 304 and the main plane of third web 162. In an exemplary embodiment, a value of the second inclination angle may be in a range between 30 degrees to 60 degrees. In an exemplary embodiment, the value of the second inclination angle may be 45 degrees.

In an exemplary embodiment, first inclined stiffener plate 302 and second inclined stiffener plate 304 may provide significant benefits. For example, first inclined stiffener plate 302 and second inclined stiffener plate 304 may close a bottom end of rectangular chamber 150. In an exemplary embodiment, it may be understood that when bottom end of rectangular chamber 150 is closed by first inclined stiffener plate 302 and second inclined stiffener plate 304, soil penetration into rectangular chamber 150 may be minimized, or otherwise prevented. In an exemplary embodiment, first inclined stiffener plate 302 and second inclined stiffener plate 304 may help multi-function retaining structure 100 to penetrate into the ground at a target location more easily. In an exemplary embodiment, first inclined stiffener plate 302, second inclined stiffener plate 304, and bottom edge 354 of third web 162 may form a wedge-shaped tip 360. In an exemplary embodiment, wedge-shaped tip 360 may help multi-function retaining structure 100 to penetrate into soil and tamper through hard rock surfaces.

Figure 4:
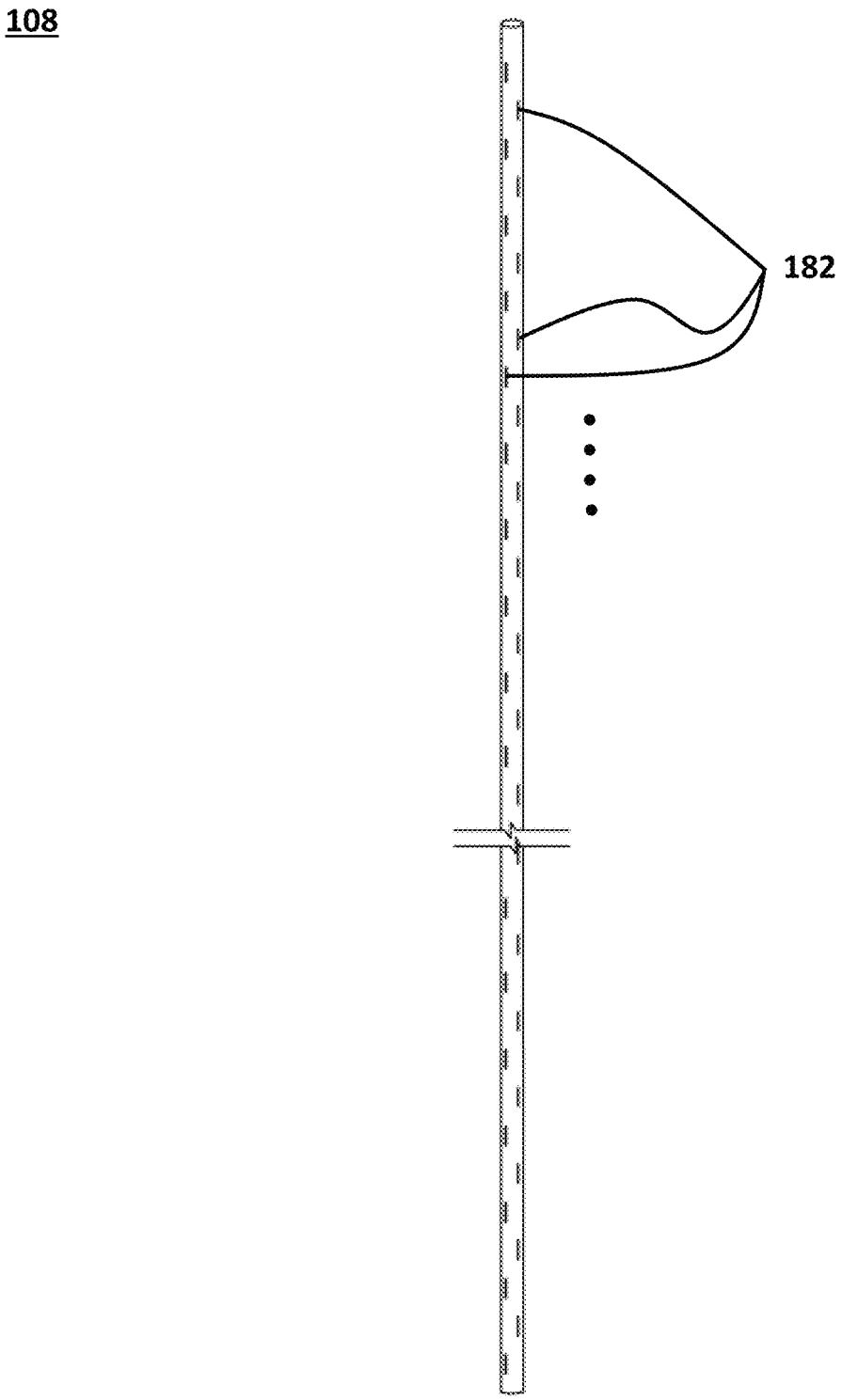
FIG. 4 illustrates a perspective view of a water carrying tube, consistent with one or more exemplary embodiments of the present disclosure.
Figure 5A:
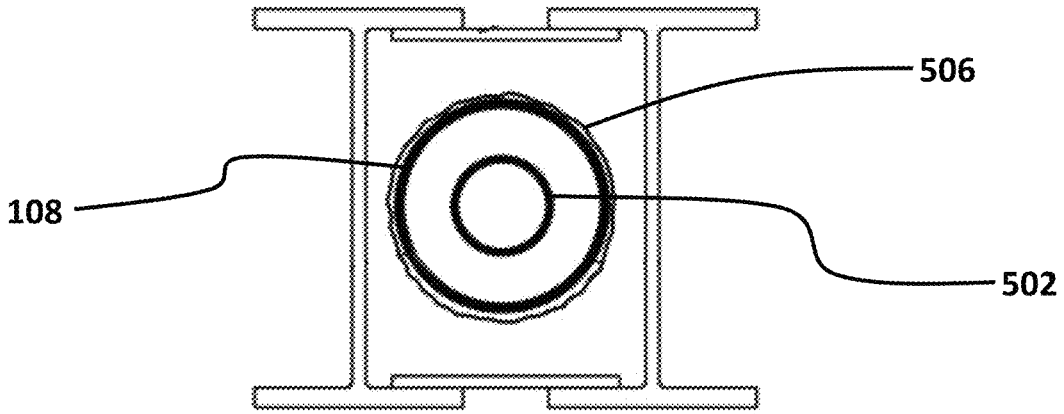
FIG. 5A illustrates a top view of a multi-function retaining structure, consistent with one or more exemplary embodiments of the present disclosure.
Figure 5B:
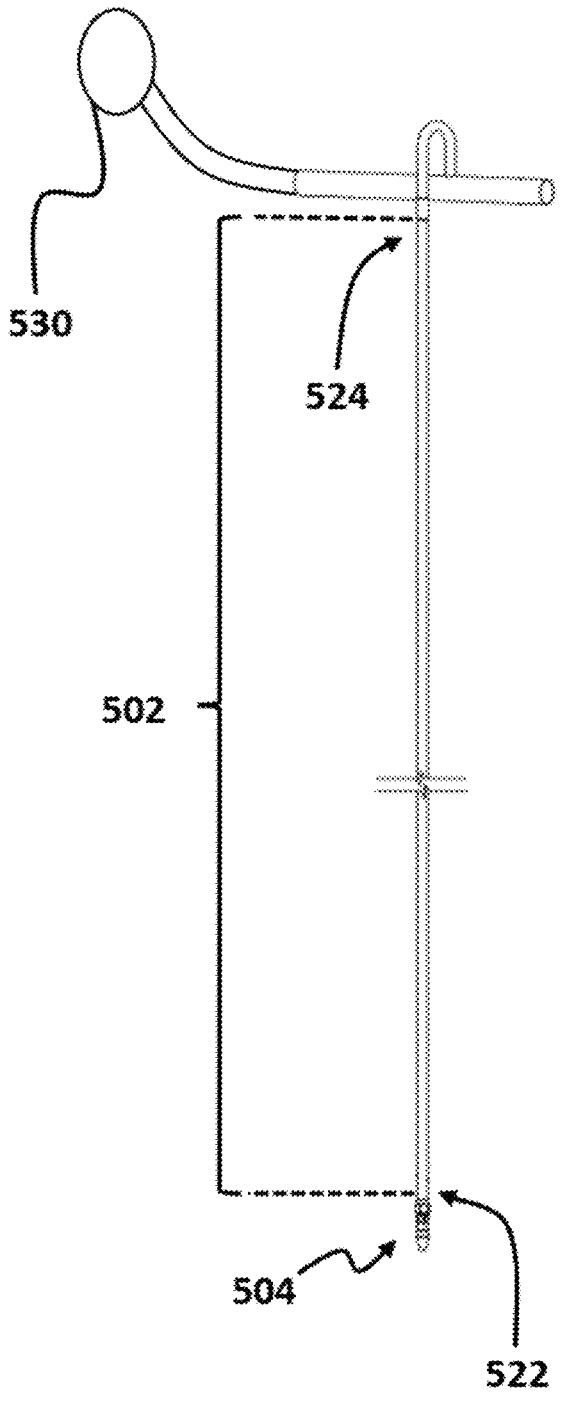
FIG. 5B illustrates a side view of a drainage tube, consistent with one or more exemplary embodiments of the present disclosure.

As shown in FIG. 1B, in an exemplary embodiment, multi-function retaining structure 100 may further include a water carrying tube 108 disposed inside rectangular chamber 150. FIG. 4 shows a perspective view of water carrying tube 108, consistent with one or more exemplary embodiments of the present disclosure. As shown in FIG. 4, in an exemplary embodiment, water carrying tube 108 may include a plurality of slots 182 on water carrying tube 108. In an exemplary embodiment, plurality of slots 182 may allow water to pass form rectangular chamber 150 into water carrying tube 108 through plurality of slots 182. FIG. 5A shows a top view of multi-function retaining structure 100, consistent with one or more exemplary embodiments of the present disclosure. As shown in FIG. 5A, in an exemplary embodiment, multi-function retaining structure 100 may further include a drainage tube 502 disposed inside water carrying tube 108. FIG. 5B shows a side view of drainage tube 502, consistent with one or more exemplary embodiments of the present disclosure.

As shown in FIG. 5B, in an exemplary embodiment, multi-function retaining structure 100 may further include a filter mechanism 504 attached to a bottom end 522 of drainage tube 502. In an exemplary embodiment, filter mechanism 504 may allow water penetration into drainage tube 502 through bottom end 522 of drainage tube 502. Furthermore, in an exemplary embodiment, filter mechanism 504 may prevent soil penetration into drainage tube 502 through bottom end 522 of drainage tube 502. In an exemplary embodiment, filter mechanism 504 may include a filter layer with a plurality of holes with a specific diameter. In an exemplary embodiment, the specific diameter of the plurality of holes may provide a facility for filter mechanism 504 to allow water penetration into drainage tube 502 and prevent soil penetration into drainage tube 502. As further shown in FIG. 5B, in an exemplary embodiment, a top end 524 of drainage tube 502 may be connected to a water drainage pump 530. In an exemplary embodiment, water drainage pump 530 may drain water from water carrying tube 108. In an exemplary embodiment, water drainage from water carrying tube 108 may be done utilizing water drainage pump 530 and through drainage tube 502. In an exemplary embodiment, water drainage pump 530 may suck water into drainage tube 502 through creating vacuum inside drainage tube 502.

Figure 5C:
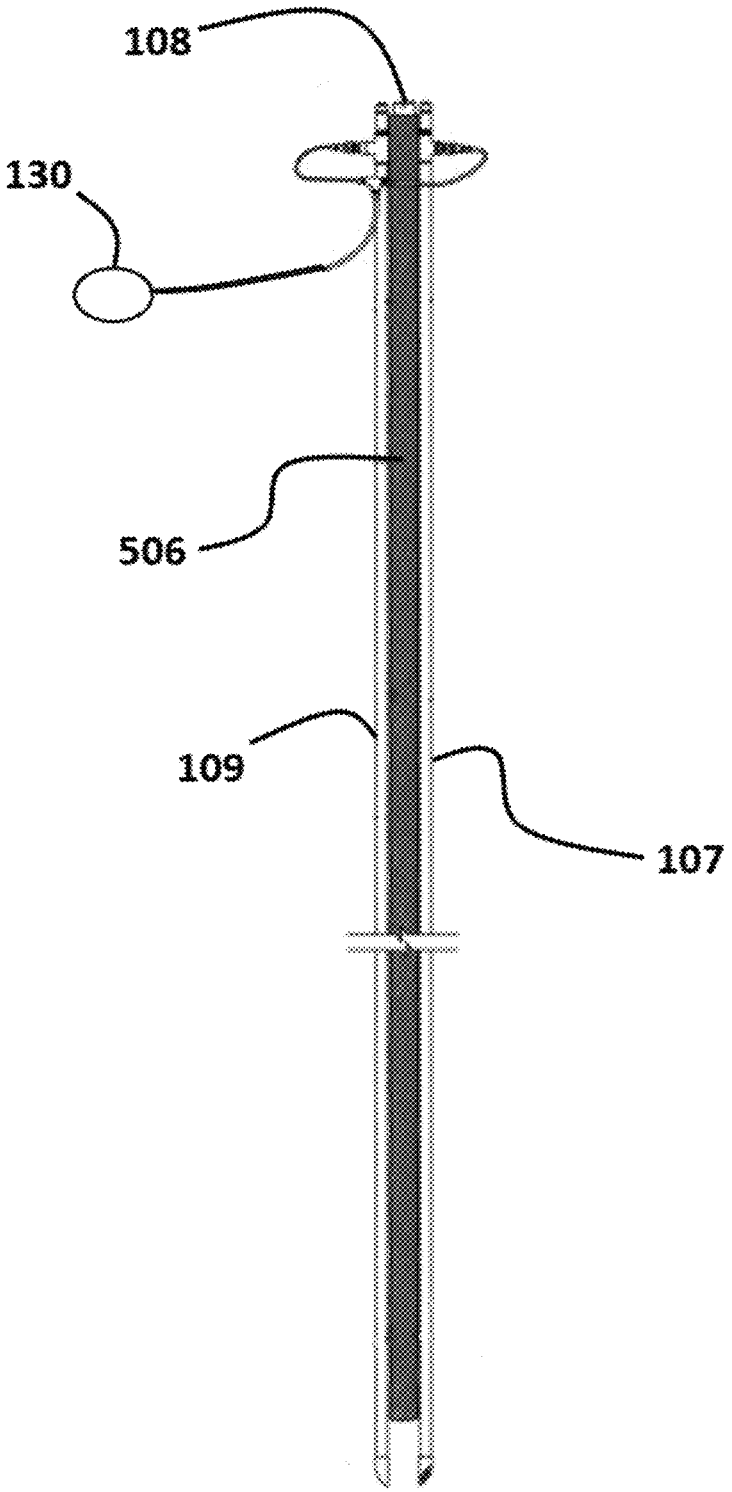
FIG. 5C illustrates a multi-function retaining structure, consistent with one or more exemplary embodiments of the present disclosure.

As further shown in FIG. 5A, in an exemplary embodiment, multi-function retaining structure 100 may further include a geotextile layer 506. FIG. 5C shows multi-function retaining structure 100, consistent with one or more exemplary embodiments of the present disclosure. As shown in FIG. 5C, in an exemplary embodiment, geotextile layer 506 may be coated onto an outer surface of water carrying tube 108. In an exemplary embodiment, geotextile layer 506 may prevent soil penetration from rectangular chamber 150 into water carrying tube 108. Furthermore, in an exemplary embodiment, geotextile layer 506 may allow water penetration from rectangular chamber 150 into water carrying tube 108. In an exemplary embodiment, geotextile layer 506 may include an open-mesh geotextile layer, a wrap-knitted geotextile layer, a closed-fabric geotextile layer, a non-woven geotextile layer, or a combination thereof.

Figure 5D:
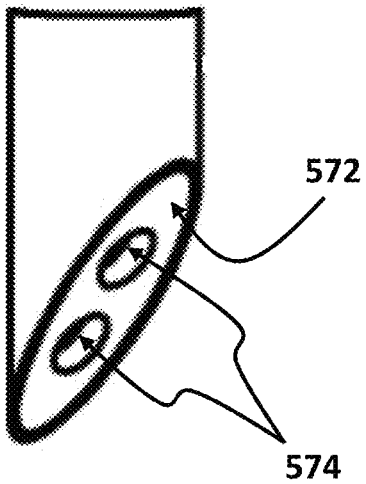
FIG. 5D illustrates a first jetting element, consistent with one or more exemplary embodiments of the present disclosure.

Referring back to FIG. 1A, FIG. 1B, and FIG. 5C, in an exemplary embodiment, multi-function retaining structure 100 may further include a first water jet tube 107. In an exemplary embodiment, as shown in FIG. 1A and FIG. 1B, first water jet tube 107 may be disposed inside rectangular chamber 150. In an exemplary embodiment, a top end 517 of first water jet tube 107 may be connected to a water jet pump 130. In an exemplary embodiment, water jet pump 130 may pump water into first water jet tube 107. In an exemplary embodiment, first water jet tube 107 may include a first jetting element 507. In an exemplary embodiment, first jetting element 507 may be configured to jet water from first water jet tube 107 with a relatively high speed and pressure. In an exemplary embodiment, first jetting element 507 may be attached to a bottom end 570 of first water jet tube 107. FIG. 5D shows first jetting element 507, consistent with one or more exemplary embodiments of the present disclosure. As shown in FIG. 5D, in an exemplary embodiment, first jetting element 507 may include a first bottom inclined surface 572 at a bottom end of first jetting element 507. In an exemplary embodiment, first jetting element 507 may further include a first pair of holes 574 on first bottom inclined surface 572. In an exemplary embodiment, first pair of holes 574 may increase intensity of water discharge from first water jet tube 107. In an exemplary embodiment, each of first pair of holes 574 may have a diameter between 0.5 millimeters and 2 millimeters. In an exemplary embodiments, it may be understood that when water discharge from bottom end 570 of first water jet tube 107, smaller diameters of first pair of holes 574, in comparison with a diameter of first water jet tube 107, may increase intensity of water discharge from bottom end 570 of first water jet tube 107.

Figure 5E:
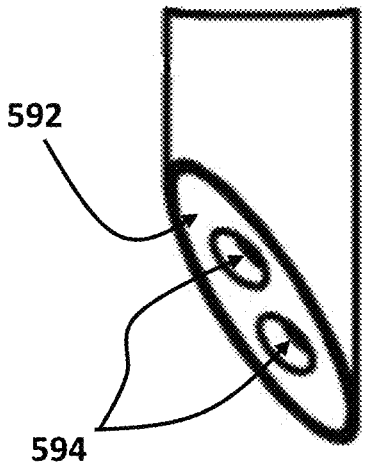
FIG. 5E illustrates a second jetting element, consistent with one or more exemplary embodiments of the present disclosure.

Referring again to FIG. 1A, FIG. 1B, and FIG. 5C, in an exemplary embodiment, multi-function retaining structure 100 may further include a second water jet tube 109. In an exemplary embodiment, as shown in FIG. 1A and FIG. 1B, second water jet tube 109 may be disposed inside water carrying tube 108. In an exemplary embodiment, a top end 519 of second water jet tube 109 may be connected to water jet pump 130. In an exemplary embodiment, water jet pump 130 may pump water into second water jet tube 109. In an exemplary embodiment, second water jet tube 109 may include a second jetting element 509. In an exemplary embodiment, second jetting element 509 may be configured to jet water from second water jet tube 109 with a relatively high speed and pressure. In an exemplary embodiment, second jetting element 509 may be attached to a bottom end 590 of second water jet tube 109. FIG. 5E shows second jetting element 509, consistent with one or more exemplary embodiments of the present disclosure. As shown in FIG. 5E, in an exemplary embodiment, second jetting element 509 may include a second bottom inclined surface 592 at a bottom end of second jetting element 509. In an exemplary embodiment, second jetting element 509 may further include a second pair of holes 594 on second bottom inclined surface 592. In an exemplary embodiment, second pair of holes 594 may increase intensity of water discharge from second water jet tube 109. In an exemplary embodiment, each of second pair of holes 594 may have a diameter between 0.5 millimeters and 2 millimeters. In an exemplary embodiments, it may be understood that when water discharge from bottom end 590 of second water jet tube 109, smaller diameters of second pair of holes 594 in comparison with a diameter of second water jet tube 109, may increase intensity of water discharge from bottom end 590 of second water jet tube 109. In an exemplary embodiment, it may be understood that utilizing first water jet tube 107 and second water jet tube 109 may provide significant benefits such as facilitation in driving multi-function retaining structure 100 into the ground. For example, when multi-function retaining structure 100 is pushed into the ground, the discharged water from first pair of holes 574 and second pair of holes 594 may soften hard soils in the ground, and to thereby, may facilitate driving multi-function retaining structure 100 into the ground.

Figure 5F:
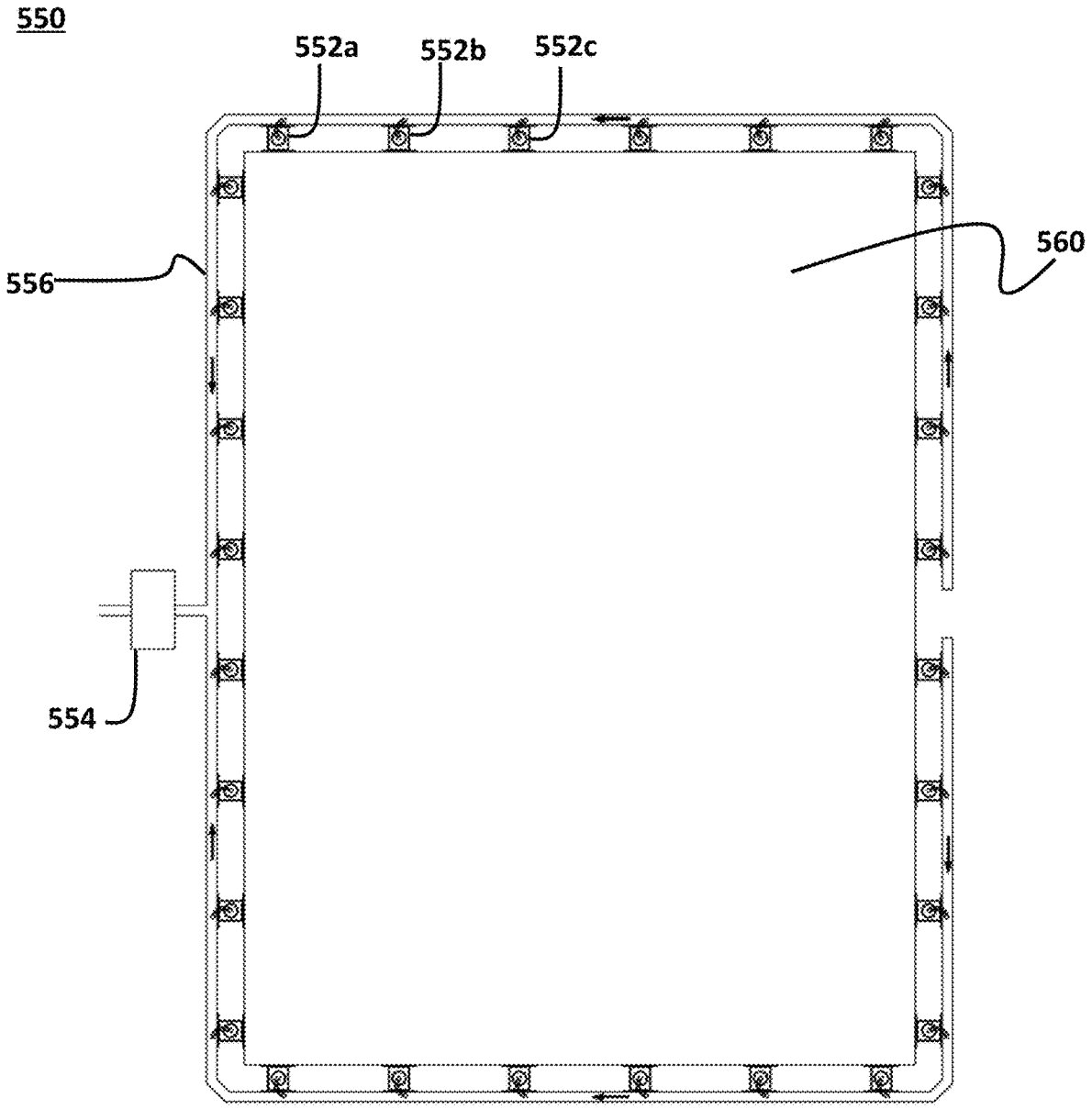
FIG. 5F illustrates an excavation system, consistent with one or more exemplary embodiments of the present disclosure.

FIG. 5F shows an excavation system 550, consistent with one or more exemplary embodiments of the present disclosure. As shown in FIG. 5F, in an exemplary embodiment, excavation system 550 may include a plurality of retaining structures such as a first retaining structure 552*a*, a second retaining structure 552*b*, and a third retaining structure 552*c*. In an exemplary embodiment, the plurality of retaining structures may include more retaining structures in addition to first retaining structure 552*a*, second retaining structure 552*b*, and third retaining structure 552*c* which are shown but not labeled in FIG. 5F. In an exemplary embodiment, each of plurality of retaining structures may be similar in structure and functionality to multi-function retaining structure 100. For example, first retaining structure 552*a*, second retaining structure 552*b*, and third retaining structure 552*c* may be similar in structure and functionality to multi-function retaining structure 100.

In an exemplary embodiment, excavation system 550 may be used to implement an excavation at an excavation zone 560. In an exemplary embodiment, excavation zone 560 may have a rectangular shape. However, in different embodiments, excavation zone 560 may have any other geometrical shapes. In an exemplary embodiment, in order to implement an excavation at excavation zone 560, the plurality of retaining structures may be arranged around excavation zone 560. In an exemplary embodiment, excavation system 550 may include a drainage pump 554. In an exemplary embodiment, drainage pump 554 may be similar in structure and functionality to water drainage pump 530.

In an exemplary embodiment, excavation system 550 may include a piping system 556. In an exemplary embodiment, drainage pump 554 may be connected to the plurality of retaining structures through piping system 556. In an exemplary embodiment, drainage pump 554 may be configured to drain water from each of the plurality of retaining structures.

Figure 5G:
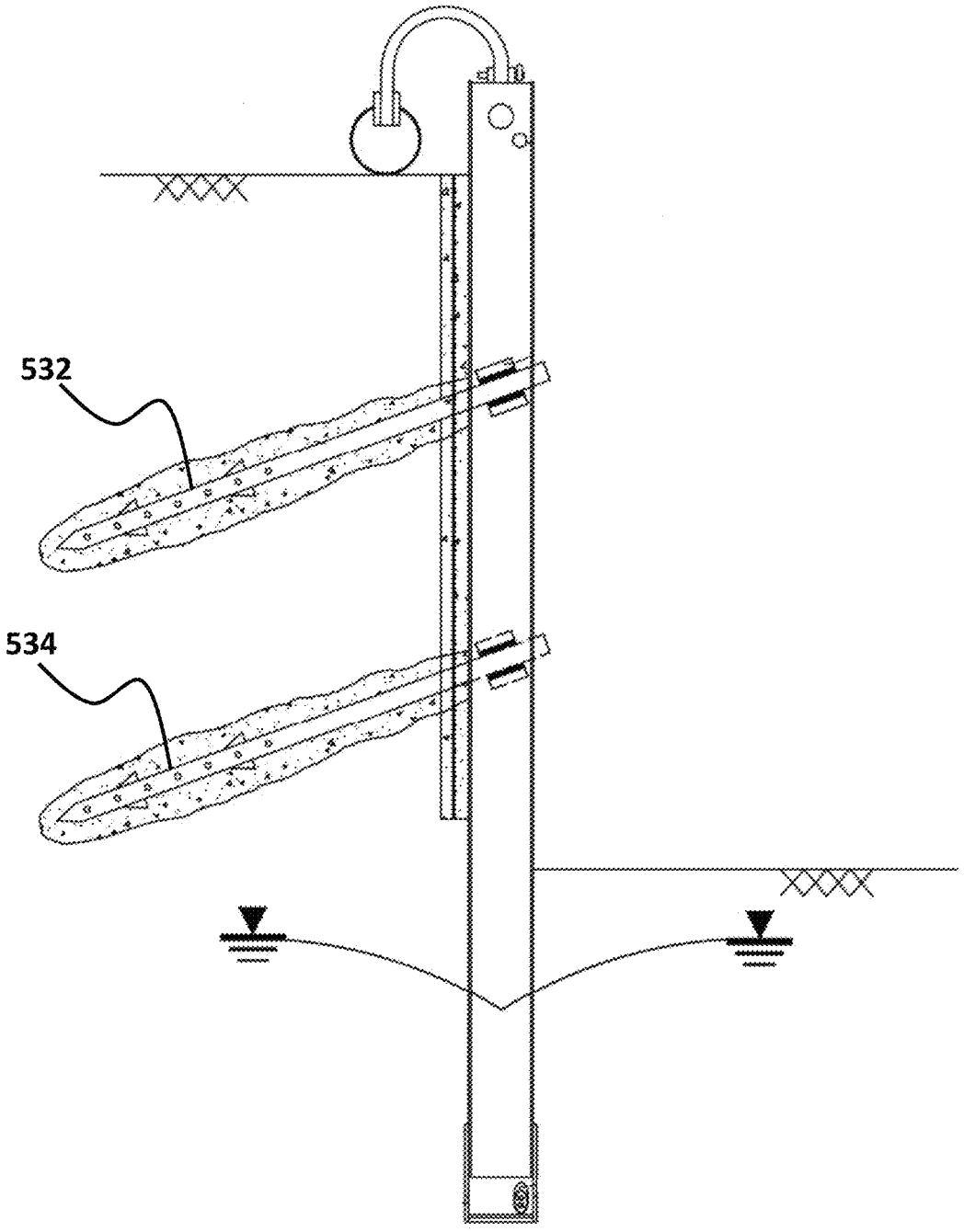
FIG. 5G illustrates a multi-function retaining structure, consistent with one or more exemplary embodiments of the present disclosure.
Figure 5H:
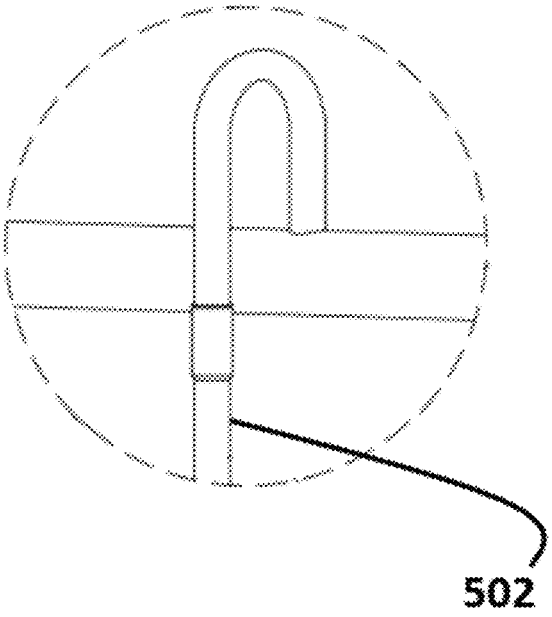
FIG. 5H illustrates a side view of a top section of a drainage tube, consistent with one or more exemplary embodiments of the present disclosure.
Figure 5I:
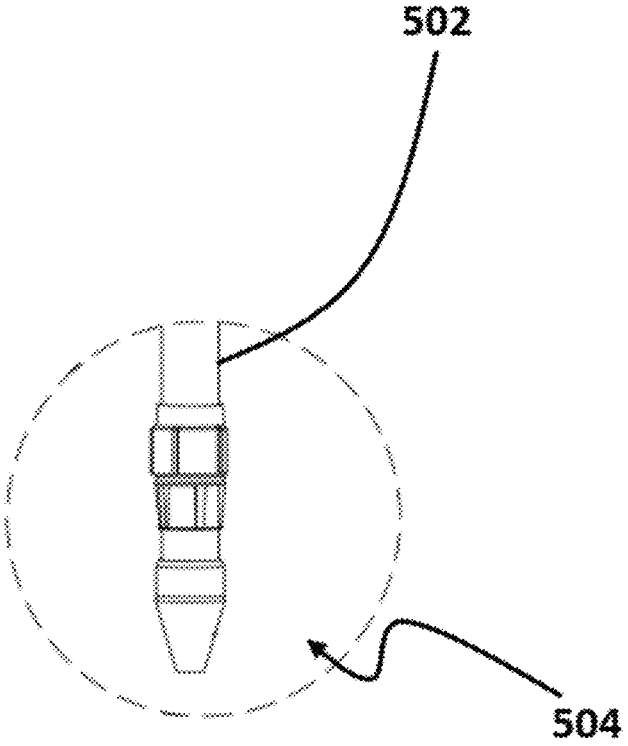
FIG. 5I illustrates a side view of a bottom section of a drainage tube, consistent with one or more exemplary embodiments of the present disclosure.
Figure 5J:
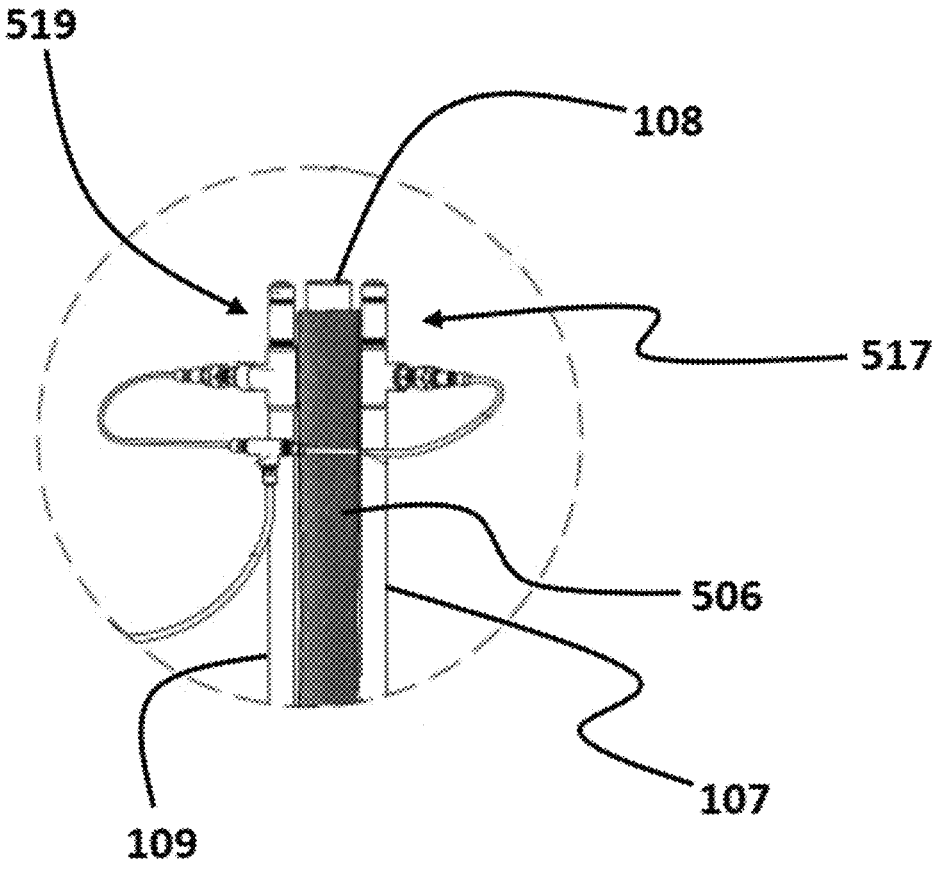
FIG. 5J illustrates a top section of a multi-function retaining structure, consistent with one or more exemplary embodiments of the present disclosure.
Figure 5K:
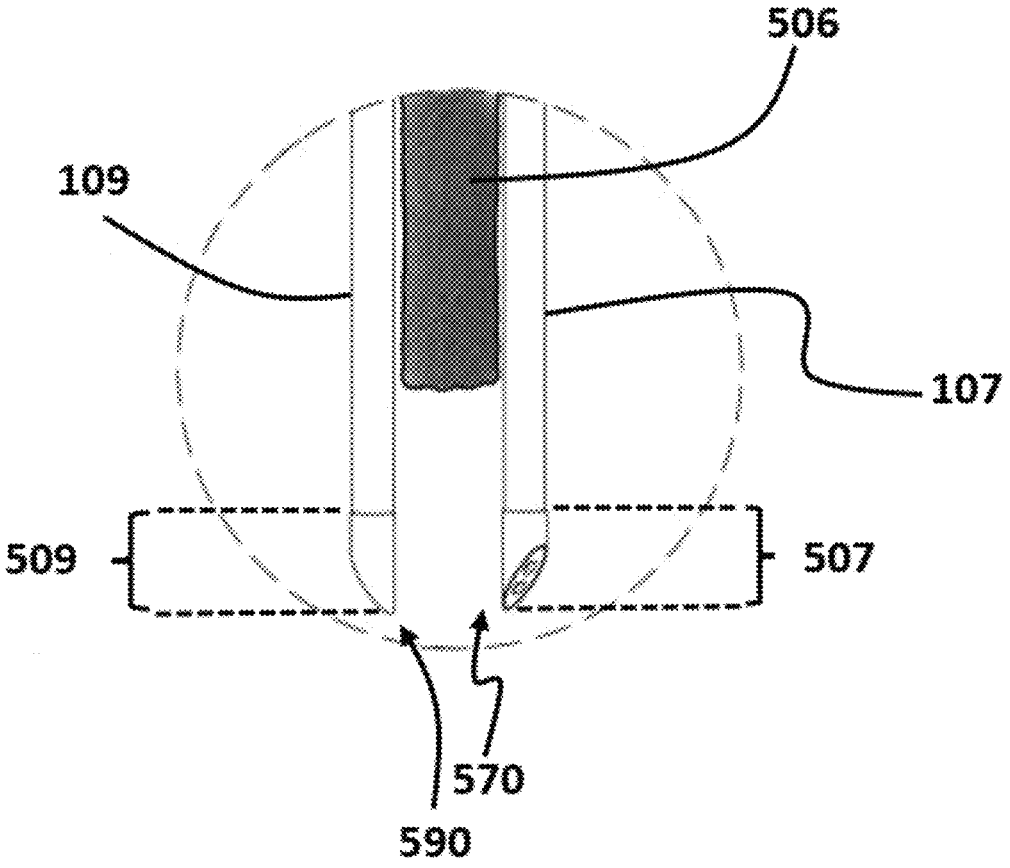
FIG. 5K illustrates a bottom section of a multi-function retaining structure, consistent with one or more exemplary embodiments of the present disclosure.

FIG. 5G shows multi-function retaining structure 100, consistent with one or more exemplary embodiments of the present disclosure. As shown in FIG. 5G, in an exemplary embodiment, a first reinforcing bar 532 and a second reinforcing bar 534. In an exemplary embodiment, first reinforcing bar 532 and second reinforcing bar 534 may be driven into soil wall to help stabilizing multi-function retaining structure 100. In an exemplary embodiment, the proximal extremity of first reinforcing bar 532 and second reinforcing bar may be open so as to receive cement slurry therewithin. FIG. 5H shows a side view of a top section of a drainage tube, consistent with one or more exemplary embodiments of the present disclosure. FIG. 5I shows a side view of a bottom section of a drainage tube, consistent with one or more exemplary embodiments of the present disclosure. FIG. 5J shows a top section of a multi-function retaining structure, consistent with one or more exemplary embodiments of the present disclosure. FIG. 5K shows a bottom section of a multi-function retaining structure, consistent with one or more exemplary embodiments of the present disclosure.

Figure 6A:
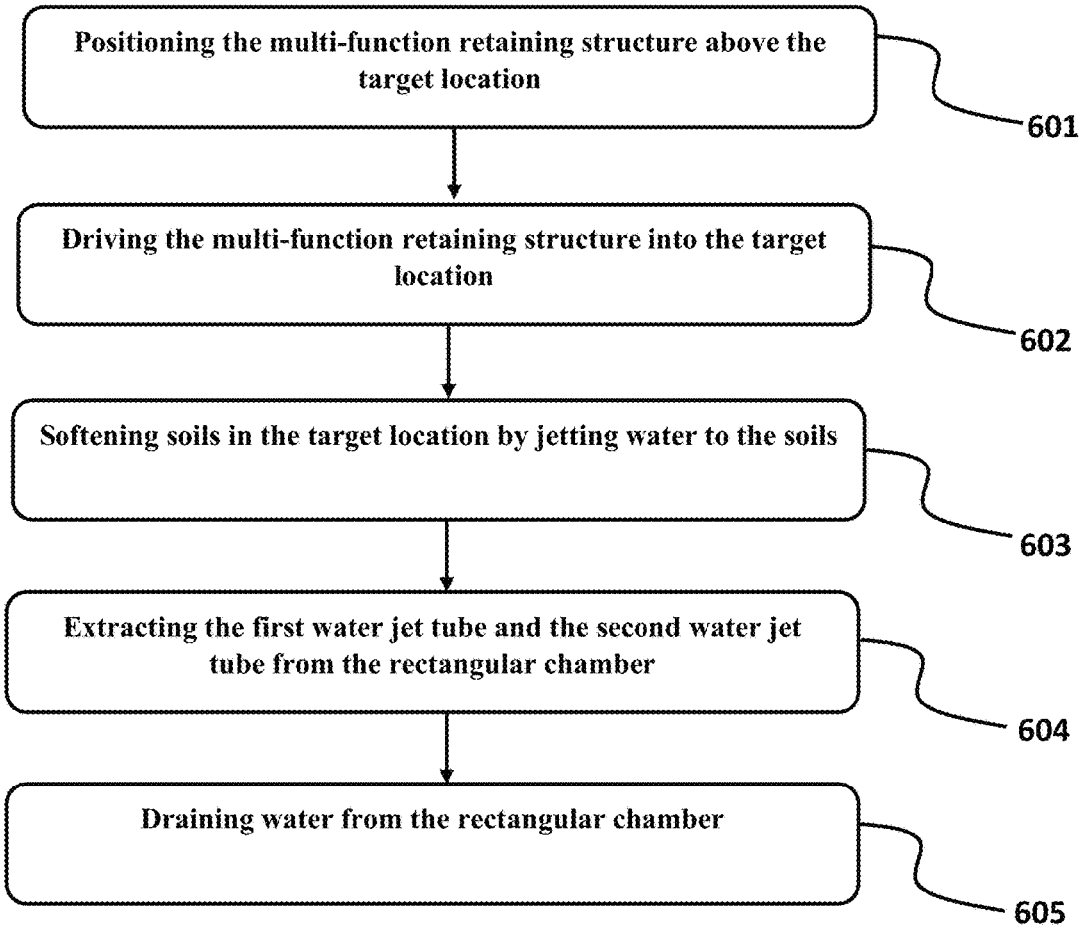
FIG. 6A is a method for excavation and implementation of a multi-function retaining structure at a target location, consistent with one or more exemplary embodiments of the present disclosure.
Figure 6B:
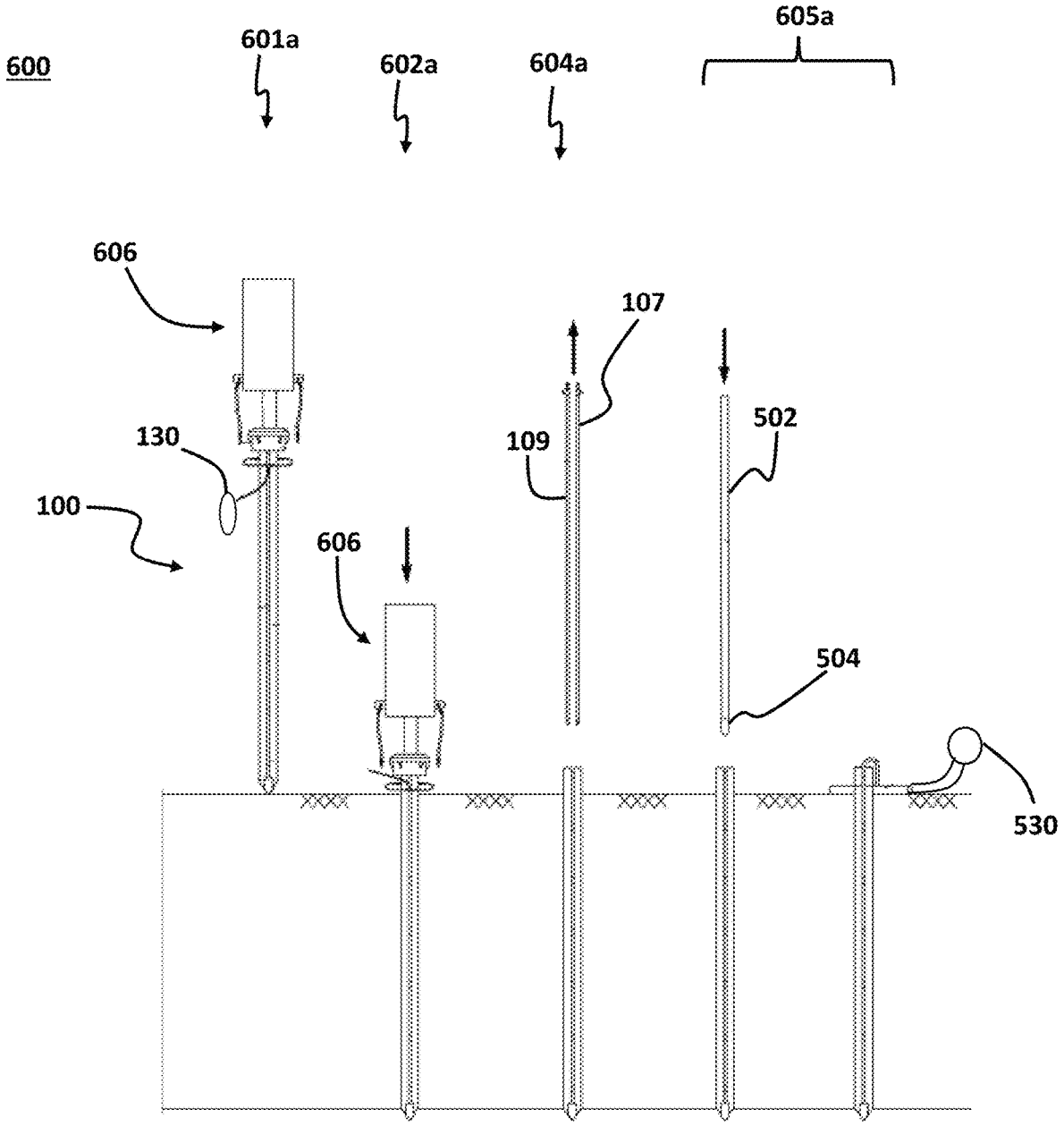
FIG. 6B illustrates a schematic implementation of a method for excavation and implementation of a multi-function retaining structure at a target location, consistent with one or more exemplary embodiments of the present disclosure.

FIG. 6A is a method 600 for excavation and implementation of a multi-function retaining structure at a target location, consistent with one or more exemplary embodiments of the present disclosure. In an exemplary embodiment, method 600 may be utilized to excavate and implement an exemplary retaining structure such as multi-function retaining structure 100 at a target location. As shown in FIG. 6A, in an exemplary embodiment, method 600 may include positioning a multi-function retaining structure above a target location (step 601), driving the multi-function retaining structure into the target location (step 602), softening soils in the target location by jetting water to the soils (step 603), extracting the first water jet tube and the second water jet tube from the rectangular chamber (step 604), and draining water from the rectangular chamber (step 605). FIG. 6B shows a schematic implementation of method 600 for excavation and implementation of a multi-function retaining structure at a target location, consistent with one or more exemplary embodiments of the present disclosure.

In an exemplary embodiment, step 601*a* in FIG. 6B may correspond to step 601 in FIG. 6A. In an exemplary embodiment, the multi-function retaining structure utilized in step 601 of method 600 may be substantially analogous in structure and functionality to multi-function retaining structure 100 as shown in FIGS. 1A and 1B. In an exemplary embodiment, step 602*a* in FIG. 6B may correspond to step 602 in FIG. 6A. In an exemplary embodiment, step 604*a* in FIG. 6B may correspond to step 604 in FIG. 6A. In an exemplary embodiment, step 605*a* in FIG. 6B may correspond to step 605 in FIG. 6A.

As shown in FIG. 6A and FIG. 6B, in an exemplary embodiment, in order to implement step 602 of method 100, bottom edge 354 of third web 162 may be pushed into the target location. In an exemplary embodiment, in order to implement step 602 of method 600, bottom edge 354 of third web 162 may be pushed into the ground at the target location by utilizing a mechanical hammer 606. In an exemplary embodiment, in order to implement step 603 of method 100, water jet pump 130 may be connected to top end of first water jet tube 107 and top end of second water jet tube 109. In an exemplary embodiment, water jet pump 130 may pump water into first water jet tube 107 and second water jet tube 109. In an exemplary embodiment, the pumped water into first water jet tube 107 and second water jet tube 109 may be discharged from bottom end 172 of first water jet tube 107 and bottom end 192 of second water jet tube 109. In an exemplary embodiment, discharged water from bottom end 172 of first water jet tube 107 and bottom end 192 of second water jet tube 109 may soften soils in the target location. In an exemplary embodiment, it may be understood that when soils in the target location are softened by discharged water from bottom end 172 of first water jet tube 107 and bottom end 192 of second water jet tube 109, multi-function retaining structure 600 may be pushed into the ground more easily. In an exemplary embodiment, step 603 of method 600 may be implemented simultaneously with implementation of step 602 of method 600. In an exemplary embodiment, it may be understood that implementing step 603 of method 600 along with simultaneously implementing step 602 of method 600 may facilitate implementation of step 602 of method 600.

In an exemplary embodiment, after completion of step 602 of method 600 and when multi-function retaining structure 100 is fully inserted into the ground, first water jet tube 107 and second water jet tube 109 may be extracted from rectangular chamber 150. In an exemplary embodiment, in order to implement step 605 of method 600, drainage tube 502 may be disposed inside rectangular chamber 150. In an exemplary embodiment, a filter mechanism 504 may be attached to a bottom end 522 of drainage tube 502. In an exemplary embodiment, a top end 524 of drainage tube 502 may be connected to a water drainage pump 530. In an exemplary embodiment, water drainage pump 530 may drain water from rectangular chamber 150.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective spaces of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A multi-function retaining structure for excavation and drainage operations during construction process, the multi-function retaining structure comprising:

a first I-beam comprising a first web;

a second I-beam comprising a second web, a first side of the first I-beam fixedly connected to a first side of the second I-beam, a main surface of the second web parallel to a main surface of the first web, the first I-beam and the second I-beam defining a rectangular chamber between the first web and the second web;

a third I-beam comprising a third web, the third I-beam interconnected between a bottom end of the first I-beam and a bottom end of the second I-beam;

a first inclined stiffener plate, a top edge of the first inclined stiffener plate attached to a bottom edge of the first web, a bottom edge of the first inclined stiffener plate attached to a bottom edge of the third web;

a second inclined stiffener plate, a top edge of the second inclined stiffener plate attached to a bottom edge of the second web, a bottom edge of the second inclined stiffener plate attached to the bottom edge of the third web;

wherein:

the first inclined stiffener plate and the second inclined stiffener plate are configured to reduce soil penetration into the rectangular chamber due to the first inclined stiffener plate and the second inclined stiffener plate closing a bottom end of the rectangular chamber;

the first inclined stiffener plate, the second inclined stiffener plate, and bottom edge of the third web form a wedge-shaped tip, the wedge-shaped tip configured to penetrate into soil and tamper through hard rock surfaces.

2. The multi-function retaining structure of claim 1, further comprising a water drainage mechanism comprising:

a water carrying tube disposed inside the rectangular chamber;

a plurality of slots provided on the water carrying tube, the plurality of slots configured to allow water to penetrate into the water carrying tube from the rectangular chamber and through the plurality of slots;

a drainage tube disposed inside the water carrying tube; and a filter mechanism attached to a bottom end of the drainage tube, the filter mechanism configured to:

allow water penetration into the drainage tube through the bottom end of the drainage tube; and prevent soil penetration into the drainage tube through the bottom end of the drainage tube;

wherein a top end of the drainage tube is connected to a water drainage pump, the water drainage pump configured to drain water from the rectangular chamber and through the drainage tube.

3. The multi-function retaining structure of claim 2, wherein:

the first I-beam further comprises:

a first lateral flange attached to a first lateral edge of the first web, a main plane of the first lateral flange perpendicular to the main plane of the first web;

a second lateral flange attached to a second lateral edge of the first web, a main plane of the second lateral flange perpendicular to the main plane of the first web, the main plane of the second lateral flange parallel to the main plane of the first lateral flange;

the second I-beam further comprises:

a third lateral flange attached to a first lateral edge of the second web, a main surface of the third lateral flange perpendicular to the main surface of the second web;

a fourth lateral flange attached to a second lateral edge of the second web, a main surface of the fourth lateral flange perpendicular to the main surface of the second web, the main surface of the third lateral flange parallel to the main surface of the fourth lateral flange;

the first lateral flange fixedly attached to the third lateral flange; and the second lateral flange fixedly attached to the fourth lateral flange.

4. The multi-function retaining structure of claim 3, further comprising a geotextile layer coated onto an outer surface of the water carrying tube, the geotextile layer configured to:

prevent soil penetration into the water carrying tube from the rectangular chamber and through the outer surface of the water carrying tube; and allow water penetration into the water carrying tube from the rectangular chamber and through the outer surface of the water carrying tube.

5. The multi-function retaining structure of claim 4, further comprising:

a first water jet tube, the first water jet tube disposed inside the rectangular chamber, the first water jet tube comprising a first jetting element at a bottom end of the first water jet tube, the first jetting element disposed inside a first jet tube hole of the first inclined stiffener plate, the first jetting element comprising:

a first bottom inclined surface at a bottom end of the first jetting element; and a first pair of holes on the first bottom inclined surface, the first pair of holes increasing intensity of water discharge from the first water jet tube; and a second water jet tube, the second water jet tube disposed inside the rectangular chamber, the second water jet tube comprising a second jetting element at a bottom end of the second water jet tube, the second jetting element disposed inside a second jet tube hole of the second inclined stiffener plate, the second jetting element comprising:

a second bottom inclined surface at a bottom end of the second jetting element; and a second pair of holes on the second bottom inclined surface, the second pair of holes increasing intensity of water discharge from the second water jet tube.

6. The multi-function retaining structure of claim 5, further comprising a water jet pump, wherein:

the water jet pump is connected to a top end of the first water jet tube;

the water jet pump is connected to a top end of the second water jet tube; and the water jet pump is configured to pump water into the first water jet tube and the second water jet tube.

7. The multi-function retaining structure of claim 6, further comprising:

a first plurality of connecting plates connecting the first side of the first I-beam to the first side of the second I-beam, each connecting plate form the first plurality of connecting plates interconnected between the first lateral flange and the third lateral flange; and a second plurality of connecting plates connecting the first side of the first I-beam to the first side of the second I-beam, each connecting plate from the second plurality of connecting plates interconnected between the second lateral flange and the fourth lateral flange.

8. The multi-function retaining structure of claim 7, wherein:

a first side of each of the first plurality of connecting plates attached fixedly to an inner side of the first lateral flange;

a second side of each of the first plurality of connecting plates attached fixedly to an inner side of the third lateral flange;

a first side of each of the second plurality of connecting plates attached fixedly to an inner side of the second lateral flange; and a second side of each of the second plurality of connecting plates attached fixedly to an inner side of the fourth lateral flange.

9. A method for excavation and implementation of a multi-function retaining structure at a target location, the method comprising:

positioning the multi-function retaining structure above the target location, the multi-function retaining structure comprising:

a first I-beam comprising a first web;

a second I-beam comprising a second web, a first side of the first I-beam fixedly connected to a first side of the second I-beam, a main surface of the second web parallel to a main surface of the first web, the first I-beam and the second I-beam defining a rectangular chamber between the first web and the second web;

a third I-beam comprising a third web, the third I-beam interconnected between a bottom end of the first I-beam and a bottom end of the second I-beam;

a first inclined stiffener plate, a top edge of the first inclined stiffener plate attached to a bottom edge of the first web, a bottom edge of the first inclined stiffener plate attached to a bottom edge of the third web;

a second inclined stiffener plate, a top end of the first inclined stiffener plate attached to a bottom end of the second web, a bottom end of the second inclined stiffener plate attached to the bottom edge of the third web;

driving the multi-function retaining structure into the target location by pushing the bottom edge of the third web into the target location;

softening soils in the target location by jetting water to the soils utilizing a first water jet tube and a second water jet tube, wherein:

the first water jet tube disposed inside the rectangular chamber, the first water jet tube comprising a first jetting element at a bottom end of the first water jet tube, the first jetting element disposed inside a first jet tube hole of the first inclined stiffener plate, the first jetting element comprising:

a first bottom inclined surface at a bottom end of the first jetting element; and a first pair of holes on the first bottom inclined surface, the first pair of holes increasing intensity of water discharge from the first water jet tube; and the second water jet tube disposed inside the rectangular chamber, the second water jet tube comprising a second jetting element at a bottom end of the second water jet tube, the second jetting element disposed inside a second jet tube hole of the second inclined stiffener plate, the second jetting element comprising:

a second bottom inclined surface at a bottom end of the second jetting element; and a second pair of holes on the second bottom inclined surface, the second pair of holes increasing intensity of water discharge from the second water jet tube;

extracting the first water jet tube and the second water jet tube from the rectangular chamber; and draining water from the rectangular chamber by utilizing a water drainage pump and through a drainage tube, wherein:

the drainage tube is disposed inside the rectangular chamber; and a top end of the drainage tube is connected to the water drainage pump.

10. The method of claim 9, further comprising reducing soil penetration into the rectangular chamber by closing a bottom end of the rectangular chamber by utilizing the first inclined stiffener plate and the second inclined stiffener plate.

11. The method of claim 10, further comprising:

disposing a water carrying tube inside the rectangular chamber; and disposing the drainage tube inside the water carrying tube.

12. The method of claim 11, further comprising allowing water penetration into the drainage tube through a bottom end of the drainage tube and preventing soil penetration into the drainage tube through the bottom end of the drainage tube by attaching a filter mechanism to the bottom end of the drainage tube.

13. The method of claim 12, further comprising allowing water to penetrate into the water carrying tube from the rectangular chamber by providing a plurality of slots on the water carrying tube.

14. The method of claim 13, further comprising preventing soil penetration into the water carrying tube from the rectangular chamber and through an outer surface of the water carrying tube and allowing water penetration into the water carrying tube from the rectangular chamber and through the outer surface of the water carrying tube by coating a geotextile layer onto the outer surface of the water carrying tube.

15. The method of claim 14, further comprising penetrating into soil and tamper through hard rock surfaces by forming a wedge-shaped tip between the first inclined stiffener plate, the second inclined stiffener plate, and the bottom edge of the third web.

16. The method of claim 15, wherein:

the first I-beam further comprises:

a first lateral flange attached to a first lateral edge of the first web, a main plane of the first lateral flange perpendicular to a main plane of the first web;

a second lateral flange attached to a second lateral edge of the first web, a main plane of the second lateral flange perpendicular to the main plane of the first web, the main plane of the second lateral flange parallel to the main plane of the first lateral flange;

the second I-beam further comprises:

a third lateral flange attached to a first lateral edge of the second web, a main surface of the third lateral flange perpendicular to the main surface of the second web;

a fourth lateral flange attached to a second lateral edge of the second web, a main surface of the fourth lateral flange perpendicular to the main surface of the second web, the main surface of the third lateral flange parallel to the main surface of the fourth lateral flange;

the first lateral flange attached to the third lateral flange; and the second lateral flange attached to the fourth lateral flange.

17. The method of claim 16, further comprising pumping water into the first water jet tube and the second water jet tube by connecting a water jet pump to a top end of the first water jet tube and a top end of the second water jet tube.

18. The method of claim 17, wherein the multi-function retaining structure further comprises:

a first plurality of connecting plates connecting the first side of the first I-beam to the first side of the second I-beam, each connecting plate form the first plurality of connecting plates interconnected between the first lateral flange and the third lateral flange; and a second plurality of connecting plates connecting the first side of the first I-beam to the first side of the second I-beam, each connecting plate from the second plurality of connecting plates interconnected between the second lateral flange and the fourth lateral flange.

19. The method of claim 18, wherein:

a first side of each of the first plurality of connecting plates attached fixedly to an inner side of the first lateral flange;

a second side of each of the first plurality of connecting plates attached fixedly to an inner side of the third lateral flange;

a first side of each of the second plurality of connecting plates attached fixedly to an inner side of the second lateral flange; and a second side of each of the second plurality of connecting plates attached fixedly to an inner side of the fourth lateral flange.

* * * * *